US006854831B2

(12) United States Patent
Kubota et al.

(10) Patent No.: US 6,854,831 B2
(45) Date of Patent: Feb. 15, 2005

(54) LIQUID DISCHARGE METHOD, LIQUID DISCHARGE HEAD, LIQUID DISCHARGE APPARATUS, AND METHOD FOR MANUFACTURING LIQUID DISCHARGE HEAD

(75) Inventors: Masahiko Kubota, Tokyo (JP); Hiroshi Sugitani, Tokyo (JP); Masanori Takenouchi, Kanagawa-ken (JP); Masami Ikeda, Tokyo (JP); Kiyomitsu Kudo, Kanagawa-ken (JP); Ryoji Inoue, Kanagawa-ken (JP); Takashi Saito, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/255,833

(22) Filed: Sep. 27, 2002

(65) Prior Publication Data

US 2003/0048334 A1 Mar. 13, 2003

Related U.S. Application Data

(62) Division of application No. 09/651,558, filed on Aug. 31, 2000, now Pat. No. 6,497,475.

(30) Foreign Application Priority Data

Sep. 3, 1999 (JP) ..... 11-250935
Feb. 15, 2000 (JP) ..... 2000-037125

(51) Int. Cl.[7] ..... B41J 2/05
(52) U.S. Cl. ..... 347/65; 347/67
(58) Field of Search ..... 347/20, 56, 61, 347/63, 65, 67, 93, 94

(56) References Cited

U.S. PATENT DOCUMENTS 4,412,224 A 10/1983 Sugitani ..... 347/65
4,417,251 A 11/1983 Sugitani ..... 347/65
4,437,100 A 3/1984 Sugitani et al. ..... 347/65
4,450,455 A 5/1984 Sugitani et al. ..... 347/45
4,480,259 A 10/1984 Kruger et al. ..... 347/63

(List continued on next page.)

FOREIGN PATENT DOCUMENTS

EP 0160463 11/1985
EP 0436047 A 1/1990
EP 0 436947 7/1991

(List continued on next page.)

*Primary Examiner*—Juanita D. Stephens
(74) *Attorney, Agent, or Firm*—Fitzpatrick, Cella, Harper & Scinto

(57) ABSTRACT

A liquid discharging method for a liquid head discharge head, which is provided with a plurality of discharge ports for discharging liquid, a plurality of liquid flow paths communicated always with each of the discharge ports at one end, each having bubble generating area for creating bubble in liquid, bubble generating means for generating energy to create and grow the bubble, a plurality of liquid supply ports each arranged for each of the liquid flow paths to be communicated with common liquid supply chamber, and movable member supported with minute gap to the liquid supply port on the liquid flow path side, and provided with free end, the area of the movable member surrounded at least by the free end portion and both sides continued therefrom being made larger than the opening area of the liquid supply port facing the liquid flow path, comprises the step of setting a period for the movable member to close and essentially cut off the opening area during the period from the application of driving voltage to the bubble generating means to the substantial termination of isotropical growth of the entire bubble by the bubble generating means, hence making it possible to enhance the suppressing efficiency of the bubble growing component in the direction opposite to the discharge port, and the refilling characteristics of liquid simultaneously.

9 Claims, 33 Drawing Sheets

U.S. PATENT DOCUMENTS

| | | | | |
|---|---|---|---|---|
| 4,496,960 | A | 1/1985 | Fischbeck | 347/68 |
| 4,509,063 | A | 4/1985 | Sugitani et al. | 347/65 |
| 4,521,787 | A | 6/1985 | Yokota et al. | 347/65 |
| 4,609,427 | A | 9/1986 | Inamoto et al. | 216/27 |
| 4,611,219 | A | 9/1986 | Sugitani et al. | 347/10 |
| 4,646,110 | A | 2/1987 | Ikeda et al. | 347/15 |
| 4,666,823 | A | 5/1987 | Yokota et al. | 430/320 |
| 4,723,129 | A | 2/1988 | Endo et al. | 347/56 |
| 4,994,825 | A | 2/1991 | Saito et al. | 347/63 |
| 5,095,321 | A | 3/1992 | Saito et al. | 347/63 |
| 5,208,604 | A | 5/1993 | Watanabe et al. | 347/47 |
| 5,262,802 | A | 11/1993 | Karita et al. | 347/87 |
| 5,278,585 | A | 1/1994 | Kartz et al. | 347/65 |
| 5,389,957 | A | 2/1995 | Kimura et al. | 347/20 |
| 5,485,184 | A | 1/1996 | Nakagomi et al. | 347/63 |
| 5,821,962 | A | 10/1998 | Kudo et al. | 347/65 |
| 5,940,957 | A | 8/1999 | Goto et al. | 29/611 |
| 6,007,187 | A | 12/1999 | Kashino et al. | 347/65 |
| 6,048,058 | A | 4/2000 | Kasamoto et al. | 347/94 |
| 6,062,680 | A | 5/2000 | Yoshihira et al. | 347/65 |
| 6,074,543 | A | 6/2000 | Yoshihira et al. | 205/75 |
| 6,095,640 | A | 8/2000 | Ishinaga et al. | 347/65 |
| 6,102,529 | A | 8/2000 | Okazaki et al. | 347/65 |
| 6,109,734 | A | 8/2000 | Kashino et al. | 347/67 |
| 6,113,224 | A | 9/2000 | Sugama et al. | 347/65 |
| 6,155,677 | A | 12/2000 | Kitani et al. | 347/65 |
| 6,206,508 | B1 | 3/2001 | Asakawa et al. | 347/65 |
| 6,270,199 | B1 | 8/2001 | Kimura et al. | 347/65 |
| 6,312,111 | B1 | 11/2001 | Kimura et al. | 347/65 |
| 6,331,050 | B1 | 12/2001 | Nakata et al. | 347/65 |
| 6,334,669 | B1 | 1/2002 | Kudo et al. | 347/65 |
| 6,378,993 | B1 | 4/2002 | Ozaki et al. | 347/65 |
| 6,497,475 | B1 * | 12/2002 | Kubota et al. | 347/65 |

FOREIGN PATENT DOCUMENTS

| | | |
|---|---|---|
| EP | 0 921002 | 6/1999 |
| EP | 0 921002 A2 | 6/1999 |
| EP | 1 080 902 | 3/2001 |
| EP | 1 080 906 | 3/2001 |
| JP | 55-81172 | 6/1980 |
| JP | 61-69467 | 4/1986 |
| JP | 62-156969 | 5/1986 |
| JP | 63-197652 | 8/1988 |
| JP | 63-199972 | 8/1988 |
| JP | 3-81155 | 4/1991 |
| JP | 04-118248 | 4/1992 |
| JP | 5-124189 | 5/1993 |
| JP | 6-87214 | 3/1994 |
| JP | 63-28654 | 2/1998 |

* cited by examiner

INITIAL CONDITION
(WHEN ENERGY IS APPLIED)

INITIAL PERIOD OF BUBBLING
(WHEN FILM BOILING IS EFFECTED)

INITIAL CONDITION
(WHEN ENERGY IS APPLIED)

INITIAL PERIOD OF BUBBLING
(WHEN FILM BOILING IS EFFECTED)

LIQUID DISCHARGE METHOD, LIQUID DISCHARGE HEAD, LIQUID DISCHARGE APPARATUS, AND METHOD FOR MANUFACTURING LIQUID DISCHARGE HEAD

This application is a division of application Ser. No. 09/651,558, filed on Aug. 31, 2000 and now U.S. Pat. No. 6,497,475.

BACKGROUND OF THE INVENTION

1. Field of the Invention

The present invention relates to a liquid discharge head for discharging liquid by creating a bubble (bubbles) with thermal energy acting upon liquid, and the method of manufacture therefor. The invention also relates to a liquid discharge apparatus that uses such liquid charge head.

Also, the present invention is applicable to a printer that records on a recording medium, such as paper, thread, fabric, cloth, leather, metal, plastic, glass, wood, ceramic, a copying machine, a facsimile equipments provided with communication system, and a word processor having a printing unit therefor. The invention further relates to an industrial recording apparatus formed complexly in combination with various processing apparatuses.

In this respect, the term "recording" referred to in the specification of the invention hereof not only means the provision of characters, graphics, and other meaningful images for a recording medium, but also, means the provision of images, such as patterns, which are not meaningful.

2. Related Background Art

Conventionally, for the so-called bubble jet recording method has been known, which is an ink jet recording method for forming images by the adhesion of ink onto a recording medium by discharging ink from discharge ports by the acting force based upon the abrupt voluminal changes following the creation of bubble by applying thermal energy or the like to liquid ink in flow paths of a recording apparatus, such as a printer. As disclosed in the specification of the U.S. Pat. No. 4,723,129, the recording apparatus that uses this bubble jet recording method is generally provided with discharge ports to discharge ink; flow paths communicated with these discharge ports; and electrothermal converting elements arranged in the flow paths to serve as energy generating means.

In accordance with a recording method of the kind, it becomes possible to record high quality images at high speeds in a lesser amount of noises, and at the same time, to arrange discharge ports for discharging ink in high density for the head using this recording method with such an excellent advantage, among some others, that recorded images are obtained in high resolution even in colors with a smaller apparatus. Therefore, the bubble jet recording method has been widely utilized for a printer, a copying machine, a facsimile equipment, and other office equipment in recent years. Further, this method has been utilized even for an industrial system, such as a textile printing apparatus.

Along with the wider utilization of bubble jet technologies and techniques for the products in various fields, there are increasingly more demands in various aspects. Then, for example, in order to obtain higher quality images, there has been proposed the driving condition whereby to provide a liquid discharge method or the like that performs excellent ink discharges at higher speeds based upon the stabilized creation of bubble or in consideration of the achievement of higher recording, there has been proposed the improved flow path configurations for obtaining a liquid discharge head having a higher refilling speed of liquid into the liquid flow path where liquid has been discharged.

Of these proposals, for the head that discharges liquid along with the growth and shrinkage of bubble created in nozzles, it has been known that the efficiency of discharge energy and the refilling characteristics of liquid tend to become unfavorably by the bubble growth in the direction opposite to the corresponding discharge port, and the resultant liquid flow caused thereby. The invention of a structure in which to enhance the discharge energy efficiency, as well as the refilling characteristics of the kind has been proposed in the specification of the European Patent Laid-Open Application EP-0436047A1.

The invention disclosed in the specification of this European Laid-Open Application is such that a first valve that cuts off the connection between the area near the discharge port and the bubble generating area, and a second valve that cuts off the connection between the bubble generating area and the ink supply portion completely, and that these valves are open and closed alternately (see FIG. 4 to FIG. 9 of the EP436047A1). For example, in accordance with the example shown in FIG. 7 of the aforesaid Laid-Open Application, a heat generating element 110 is arranged substantially in the center of the ink flow path 112 between the ink tank 116 and the nozzle 115 on the base plate 125 that forms the inner wall of the ink flow path 112 as shown in FIG. 37 hereof. The heat generating element 110 resides in the section 120 which closes all the circumferences in the interior of the ink flow path 112. The ink flow path 112 comprises the base plate 125; the thin films 123 and 126 which are laminated directly on the base plate 125; and tongue pieces 113 and 130 serving as closing devices. The tongue pieces in releasing condition are indicated by broken lines in FIG. 37. The other thin film 123 which extends on the flat plane parallel to the base plate 125 and terminates by the stopper 124 is arranged to shield over the ink flow path 112. When a bubble is created in ink, the free end of the tongue piece 130 on the nozzle region, which is in contact with the stopper 124 in its stationary condition, is displaced toward upward. Thus, ink liquid is discharged from the section 120 into the ink flow path 112, and discharged through the nozzle 115. At this juncture, the tongue piece 113, which is arranged in the area of the ink tank 116, is closely in contact with the stopper 124 in the stationary condition. Therefore, there is no possibility that ink liquid in the section 120 is directed to the ink layer 116. When the bubble in ink is extinct, the tongue piece 130 is displaced downward, and it is again closely in contact with the stopper 124. Then, the tongue piece 113 falls down in the ink section 120, thus allowing ink liquid to flow into the section 120.

SUMMARY OF THE INVENTION

However, in accordance with the invention described in the specification of the EP436047A1, the three chambers for the area near the discharge port, the bubble generating portion, and the ink supply portion are divided into two each. Therefore, ink that follows the ink droplet becomes a long tail when discharged, and satellites may ensue inevitably more than the usual method of discharge where the growth, shrinkage, and extinction of bubble are carried out (presumably, because the effect of the meniscus retraction that may be produced by the bubble extinction is not usable). Also, the valve on the discharge port side of the bubble tends to invite a great loss of discharge energy. Moreover, at the time of refilling (when ink is replenished for the nozzle), liquid cannot be supplied to the area near the discharge port until the next bubbling takes place, although liquid is supplied to the bubble generating portion along with the extinction of bubble. As a result, not only the fluctuation of discharged droplets is greater, but the frequency of discharge responses becomes extremely smaller, hence making this method far from being practicable.

With the present invention, it is intended to propose the devise to enhance the discharge efficiency satisfactorily based upon a new idea whereby to find an epoch-making method and head structure by improving the efficiency of suppression of the bubble growing component in the direction opposite to the discharge port, while satisfying the higher enhancement of the refilling characteristics, which is directly-opposed idea of providing more suppression on such component of growing bubble on the opposite side of the discharge port.

As a result of the assiduous studies made by the inventors hereof, it has been found to be able to utilize the discharge energy directed backward on the discharge port side effectively by means of check-valve mechanism specially constructed in the nozzle structure of a liquid discharge head that discharges liquid along with the growth of bubble created in the nozzle which is linearly formed. Here, with the special check-valve mechanism, the growing component of bubble directed backward is suppressed, and at the same time, the refilling characteristics are made more efficient. It has been found then that the frequency of discharge responses is made higher significantly.

In other words, it is an object of the present invention to establish a new discharging method (structure) whereby to attain a head capable of obtaining the high quality images at high speed, which have never been obtainable with the conventional art, with the nozzle structure and discharging method that use a novel valve mechanism.

The liquid discharging method of the present invention obtained in the process of the aforesaid studies of the liquid head discharge head, which is provided with a plurality of discharge ports for discharging liquid; a plurality of liquid flow paths communicated always with each of the discharge ports at one end, each having bubble generating area for creating bubble in liquid; bubble generating means for generating energy to create and grow the bubble; a plurality of liquid supply ports each arranged for each of the liquid flow paths to be communicated with common liquid supply chamber; and movable member supported with minute gap to the liquid supply port on the liquid flow path side, and provided with free end, the area of the movable member surrounded at least by the free end portion and both sides continued therefrom being made larger than the opening area of the liquid supply port facing the liquid flow path, comprises the step of setting a period for the movable member to close and essentially cut off the opening area during the period from the application of driving voltage to the bubble generating means to the substantial termination of isotropical growth of the entire bubble by the bubble generating means.

Also, for the aforesaid liquid discharging method, the period for the movable member to close and essential cut off the opening area continues at least until the termination of the period of substantially isotropical growth of the entire bubble by the bubble generating means.

Further, for the aforesaid liquid discharging method, during the growing period of the portion of the bubble created by the bubble generating means on the discharge port side after the period for the movable member to close and substantially cut off the opening area, the movable member begins to be displaced from the position of closing and substantially cutting off the opening area to the bubble generating means side in the liquid flow path, and makes liquid supply possible from the common liquid supply chamber to the liquid flow path.

Further, after the movable member begins to be displaced from the position of closing and substantially cutting off the opening area to the bubble generating means side in the liquid flow path, the movable member is further displaced to the bubble generating means side during the shrinking period of the portion of the bubble on the movable member side to supply liquid from the common liquid supply chamber to the liquid flow path.

Further, the voluminal changes of bubble growth and the period from the generation of bubble to the extinction thereof on the bubble generating area are different largely on the discharge port side and the liquid supply port side.

The liquid discharge head of the present invention comprises a plurality of discharge ports for discharging liquid; a plurality of liquid flow paths communicated always with each of the discharge ports at one end, each having bubble generating area for creating bubble in liquid; bubble generating means for generating energy to create and grow the bubble; a plurality of liquid supply ports each arranged for each of the liquid flow paths to be communicated with common liquid supply chamber; and movable member supported with minute gap of 10 $\mu$m or less to the liquid supply port on the liquid flow path side, and provided with free end, the area of the movable member surrounded at least by the free end portion and both sides continued therefrom being made larger than the opening area of the liquid supply port facing the liquid flow path, and the discharge port and the bubble generating means being in linearly communicative state.

Also, the liquid discharge head of the present invention comprises a discharge port for discharging liquid; a liquid flow path communicated always with the discharge port at one end, having bubble generating area for creating bubble in liquid; bubble generating means for generating energy to create and grow the bubble; a liquid supply port arranged for the liquid flow path to be communicated with common liquid supply chamber; and movable member supported with minute gap of 10 $\mu$m or less to the liquid supply port on the liquid flow path side, and provided with free end, the area of the movable member surrounded at least by the free end portion and both sides continued therefrom being made larger than the opening area of the liquid supply port facing the liquid flow path, and the discharge port and the bubble generating means being in linearly communicative state.

For these liquid discharge heads, it is preferable to provide the movable member also with gaps to with flow path walls forming the liquid flow path.

Also, the liquid discharge head of the present invention comprises a plurality of discharge ports for discharging liquid; a plurality of liquid flow paths communicated always with each of the discharge ports at one end, each having bubble generating area for creating bubble in liquid; bubble generating means for generating energy to create and grow the bubble; a plurality of liquid supply ports each arranged for each of the liquid flow paths to be communicated with common liquid supply chamber; and movable member supported with minute gap to the liquid supply port on the liquid flow path side, and provided with free end, the area of the movable member surrounded at least by the free end portion and both sides continued therefrom being made larger than the opening area of the liquid supply port facing the liquid flow path, and having a period for the movable member to close and essentially cut off the opening area during the period of substantially isotropical growing of the entire bubble by the bubble generating means on the discharge port side after the application of driving voltage to the bubble generating means, and the movable member beginning to be displaced from the position of closing and essentially cut off the opening area to the bubble generating means side in the liquid flow path during the period of the portion of bubble created by the bubble generating means on the discharge port side being grown after the period of the same movable member to close and essentially cut off the opening area, making liquid supply possible from the common liquid supply chamber to the liquid flow path. For this liquid discharge head, given the maximum volume of bubble growing in the bubble generating area on the discharge port side as Vf, and given the maximum volume of bubble growing in the bubble generating area on the liquid supply port side as Vr, the relationship of Vf>Vr is established at all times.

In this case, given the life time of bubble growing in the bubble generating area on the discharge port side as Tf, and given the life time of bubble growing in the bubble generating area on the liquid supply port side as Tr, the relationship of Tf>Tr is established at all times.

Then, the point of the bubble extinction is positioned on the discharge port side from the central portion of the bubble generating area.

Also, the liquid discharge head of the present invention comprises a plurality of discharge ports for discharging liquid; a plurality of liquid flow paths communicated always with each of the discharge ports at one end, each having bubble generating area for creating bubble in liquid; bubble generating means for generating energy to create and grow the bubble; a plurality of liquid supply ports each arranged for each of the liquid flow paths to be communicated with common liquid supply chamber; and movable member supported with minute gap to the liquid supply port on the liquid flow path side, and provided with free end, the area of the movable member surrounded at least by the free end portion and both sides continued therefrom being made larger than the opening area of the liquid supply port facing the liquid flow path, and the free end of the movable member being minutely displaced in the liquid flow path to the liquid supply port side in the initial stage of the bubble creation, and along with the bubble extinction, the free end of the movable member is largely displaced in the liquid flow path to the bubble generating means side for supplying liquid from the common liquid supply chamber into the liquid flow path through the liquid supply port.

In this case, the amount of displacement of the free end of the movable member is defined as h1 as the amount of displacement in the liquid flow path to the liquid supply port side in the initial stage of the bubble creation, and when the free end of the movable member is displaced in the liquid flow path to the bubble generating means side along with the bubble extinction, the amount of displacement thereof is defined as h2, and then, the relationship of h1<h2 is established at all times.

For each of the aforesaid liquid discharge heads, thin film of amorphous alloy is provided for the uppermost surface of the bubble generating means. Then, it is conceivable that the aforesaid amorphous alloy is an alloy of at least one metal or more selected from tantalum, iron, nickel, chromium, germanium, ruthenium.

Further, for the aforesaid liquid discharge head, it is preferable to integrally form the food supporting member with the movable member to support the foot of the movable member, and provide such member with a step for deviating the height position of the movable member by one step to the fixing position of the foot supporting member, and to make the thickness of the movable member larger than the amount of such step.

Further, it is preferable to arrange the relationship between a gap $\alpha$ between the opening edge of the liquid supply port on the liquid flow path side and the face of the movable member on the liquid flow supply port side, and the overlapping width W3 of the movable member in the widthwise direction overlapping with the opening edge of the liquid supply port on the liquid flow path side to be W3>$\alpha$.

Further, it is preferable to arrange the relationship between the overlapping width W4 of the movable member in the discharge port direction overlapping with the opening edge of the liquid supply port on the liquid flow path side, and the overlapping width W3 of the movable member in the widthwise direction to be W3>W4.

The present invention also provides a liquid discharge apparatus which comprises a liquid discharge head structured as described above, and recording medium carrying means for carrying a recording medium receiving liquid discharge from the liquid discharge head. With this liquid discharge apparatus, it is conceivable to discharge ink from the liquid discharge head for recording by the adhesion of the ink to the recording medium.

Also, the method of the present invention for manufacturing a liquid discharge head, which is provided with a plurality of discharge ports for discharging liquid; a plurality of liquid flow paths communicated always with each of the discharge ports at one end, each having bubble generating area for creating bubble in liquid; bubble generating means for generating energy to create and grow the bubble; a plurality of liquid supply ports each arranged for each of the liquid flow paths to be communicated with common liquid supply chamber; and movable member supported with minute gap to the liquid supply port on the liquid flow path side, and provided with free end, the area of the movable member surrounded at least by the free end portion and both sides continued therefrom being made larger than the opening area of the liquid supply port facing the liquid flow path, comprises the steps of forming and patterning a first protection layer with respect to the area covering the portion of the elemental base plate provided with the bubble generating means becoming the liquid flow path; forming a first wall material used for the formation of the liquid flow path on the surface of the elemental base plate including the first protection layer; removing the portion of the first wall material becoming the liquid flow path; burying the portion of the first wall material becoming the removed liquid flow path; smoothing the entire surface of the first wall material by polishing; forming a second protection film on the smoothed first wall material for the formation of a fixing portion for the first wall material and the movable member; forming by patterning the material film becoming the movable member in a smaller width than the portion becoming the liquid flow path on the location corresponding to the portion becoming the liquid flow path; forming on the circumference of the material film becoming the movable member a gap formation member to form a gap between the movable member and the liquid supply port; forming on the first wall material a second wall material for the formation of the liquid supply port on the base plate including the gap formation member;

forming the portion of the second wall material becoming the liquid supply port so as to make the opening area thereof smaller than the material film becoming the movable member; removing by resolving the first protection layer used for burying the gap formation member, the second protection layer, and the portion of the first wall material becoming the liquid flow path; and bonding the ceiling plate provided with the common liquid supply chamber to the base plate produced in the steps up to the previous stage.

Also, the method structured as described above for manufacturing a liquid discharge head, which is provided with a plurality of discharge ports for discharging liquid; a plurality of liquid flow paths communicated always with each of the discharge ports at one end, each having bubble generating area for creating bubble in liquid; bubble generating means for generating energy to create and grow the bubble; a plurality of liquid supply ports each arranged for each of the liquid flow paths to be communicated with common liquid supply chamber; and movable member supported with minute gap to the liquid supply port on the liquid flow path side, and provided with free end, the area of the movable member surrounded at least by the free end portion and both sides continued therefrom being made larger than the opening area of the liquid supply port facing the liquid flow path, comprises the steps of forming and patterning a first protection layer with respect to the portion of the ceiling plate becoming the walls of the liquid flow path; forming on the portion of the ceiling plate having none of the first protection layer a gap formation member for the formation of a gap between the movable member and the liquid supply port; forming the material film becoming the movable member on the entire surface of the first protection layer and the gap formation member; forming the material film becoming the movable member with a pattern larger than the opening area of the portion becoming the liquid supply port, and forming through holes on the movable member to facilitate flowing in liquid to resolve the gap formation member; forming by dry etching the common liquid supply chamber with the gap formation member as etching stop layer; removing the gap formation member; forming the liquid supply port by wet etching anisotropically the portion of the ceiling plate having none of the first protection layer; burying the through holes of the movable member with the same material as the material film becoming the movable member, and coating with the film the walls on the etching side; bonding the elemental base plate provided with the wall member for the formation of the liquid flow path and the bubble generating means to the member produced in the steps up to the previous stage.

With the structure described above, the movable member cuts off immediately the communicative condition between the liquid flow path and the liquid supply port during the period from the application of driving voltage to the bubble generating means to the termination of substantially isotropical growth of bubble by the bubble generating means. As a result, the waves of pressure exerted by the bubble growth in the bubble generating area is not propagated to the liquid supply port side and the common liquid supply chamber side. Most of all the pressure is directed toward the discharge port side. Thus, the discharge power is enhanced remarkably. Also, even when a highly viscous recording liquid is used for a higher fixation on a recording sheet or the like or used for the elimination of spreading on the boundary between black and other colors, it becomes possible to discharge such liquid in good condition due the remarkable enhancement of discharge power. Also, the environmental changes at the time of recording, particularly, under the environment of lower temperature and lower humidity, the overly viscous ink region tends to increase, and in some cases, ink is not normally discharged when beginning its use. However, with the present invention, it is possible to perform discharging in good condition form the very first shot. Also, with the remarkably improved discharge power, the size of the heat generating element that serves as bubble generating means can be made smaller or the input energy can be made smaller.

Also, along with the shrinkage of bubble, the movable member is displaced downward to enable liquid to flow from the common liquid supply chamber into the liquid flow path in a large quantity at a rapid flow rate through the liquid supply port. In this manner, the flow that draws meniscus into the liquid flow path is quickly reduced after the droplet is discharge, and the amount of meniscus retraction is made smaller at the discharge port accordingly. As a result, the meniscus returns to the initial state in an extremely short period of time. In other words, the replenishment of a specific amount of ink into the liquid flow path (refilling) is very quick, hence remarkably enhancing the discharge frequency (driving frequency) when executing highly precise ink discharge (in a regular quantity).

Further, in the bubble generating area, the bubble growth is large on the discharge port side, while suppressing the growth thereof toward the liquid supply port side. Therefore, bubble extinction point is positioned on the discharge port side from the central portion of the bubble generating area. Then, while maintaining the discharge power, it becomes possible to reduce the power of bubble extinction. This makes it possible to protect the heat generating member from being mechanically and physically destructed by the bubble extinction in the bubble generating area, and contribute to improving its life significantly.

Also, the foot supporting member is integrally formed with the movable member to support the foot of the movable member, which is provided with a step so that the height position of the movable member is deviated by one step from the fixing position of the foot supporting member. With this arrangement, when the movable member is displaced, the concentration of stress on the fixing position of the foot supporting member of the movable member is relaxed. Further, the thickness of the movable member is made larger than the stepping amount of the foot supporting member of the movable member, hence making it possible to enhance the durability of the foot portion of the movable member, because the concentration of stress is relaxed when it is concentrated on the stepping portion of the foot supporting member of the movable member when the movable member is displaced.

Further, the relationship between the gap $\alpha$ between the opening edge of the liquid supply port on the liquid flow path side and the face of the movable member on the liquid supply port side, and the overlapping with W3 of the movable member in the widthwise direction, is overlapped with opening edge of the liquid supply port on the liquid flow path side is established to be $W3>\alpha$. Thus, as compared with the case where this relationship is $W3\leqq\alpha$, the flow resistance becomes greater in the flow from the liquid flow path to the liquid supply port side to make it possible to effectively suppress the flow from the liquid flow path to the liquid supply port side at the bubble initiation of the bubble growth. Further, it is possible to effectively suppress the flow from the liquid flow path into the liquid supply port through the gap between the movable member and the circumference of the liquid supply port. As a result, the movable member is able to shield the liquid supply port reliably and quickly. With this operation, the discharge efficiency is enhanced still more.

Also, the relationship between the overlapping width W4 of the movable member in the discharge port direction, which is overlapped with the opening edge of the liquid supply port on the liquid flow path side, and the overlapping width W3 in the widthwise direction of the movable member is established to be W3>W4. With this arrangement, the contact width between the free end tip of the movable member and the opening edge of the liquid supply port becomes smaller when the movable member, which has been displaced upward to the liquid supply port side by the initial bubbling, begins to be displaced downward to the bubble generating means side in the process of the bubble extinction. As a result, the friction force that may be generated at that time is reduced to make it possible to release the liquid supply port priorly from the free end side of the movable member. This makes the releasing of the liquid supply port by the movable member reliably and quickly. Consequently, refilling into the liquid flow path is carried out more efficiently to stabilize the discharge characteristics.

Also, with the adoption of thin film of amorphous alloy for the cavitation proof film on the uppermost surface layer of bubble generating means, it becomes possible to make its life longer against the mechanical and physical destruction.

Also, in the manufacturing processes of the liquid discharge head in accordance with the present invention, the adoption of the amorphous alloy makes it possible to considerably reduce the damages that may be caused to the wiring layer which is arranged on the lower layer even in the removal step whereby to remove the Al film for the formation of the liquid flow path and liquid supply port as well. This contributes significantly to enhancing the production yield.

The other effects and advantages of the present invention will be understandable from the description of each embodiment which is given below.

In this respect, the terms "upstream" and "downstream" used for the description of the present invention are the expressions to indicate the liquid flow in the direction toward the discharge port from the supply source of liquid through the bubble generating area (or through the movable member) or to indicate the direction on the structural aspect thereof.

Also, the term "downstream side" of bubble itself means the downstream side of the center of the bubble in the aforesaid flow direction or the aforesaid structural direction, or it means the bubble to be created on the area on the downstream side of the central area of the heat generating element.

Also, the term "overlapping width" indicates the minimal distance from the opening edge of the liquid supply port on the liquid flow path side to the edge portion of the movable member.

Also, the expression "the movable member closes and essentially cuts off the liquid supply port" used for the present invention does not mean that the movable member is necessarily in contact closely with the circumference of the liquid supply port, but it means to include a condition where the movable member approaches the liquid supply port as close as possible.

BRIEF DESCRIPTION OF THE DRAWINGS

FIG. 33A shows the one which is provided with a protection film; FIG. 33B, the one which is not provided with any protection film.

DETAILED DESCRIPTION OF THE PREFERRED EMBODIMENTS

Now, hereinafter, with reference to the accompanying drawings, the description will be made of the embodiments in accordance with the present invention.

(First Embodiment)

Figure 1:
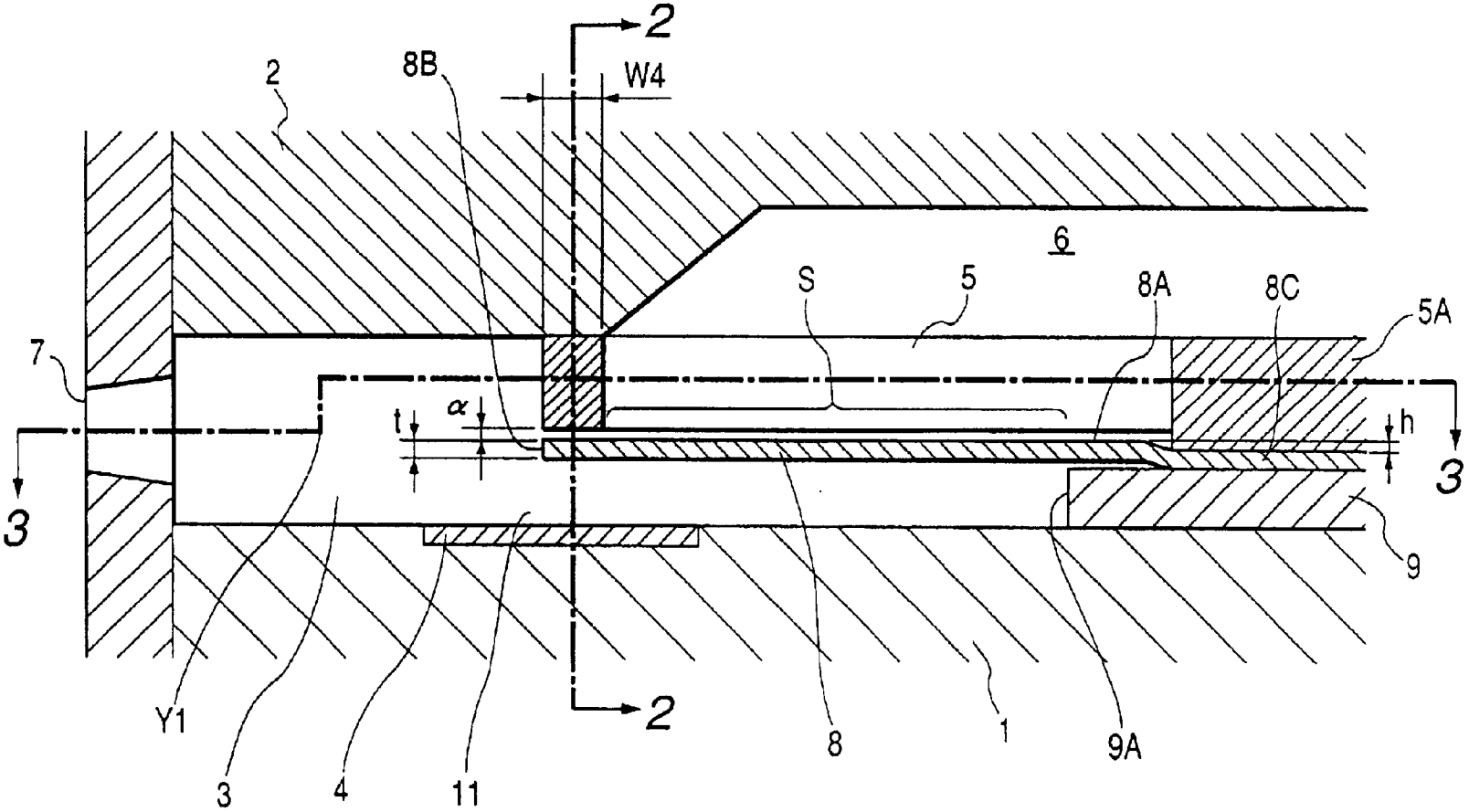
FIG. 1 is a cross-sectional view which shows a liquid discharge head in accordance with a first embodiment of the present invention, taken in the direction of one liquid flow path.
Figure 2:
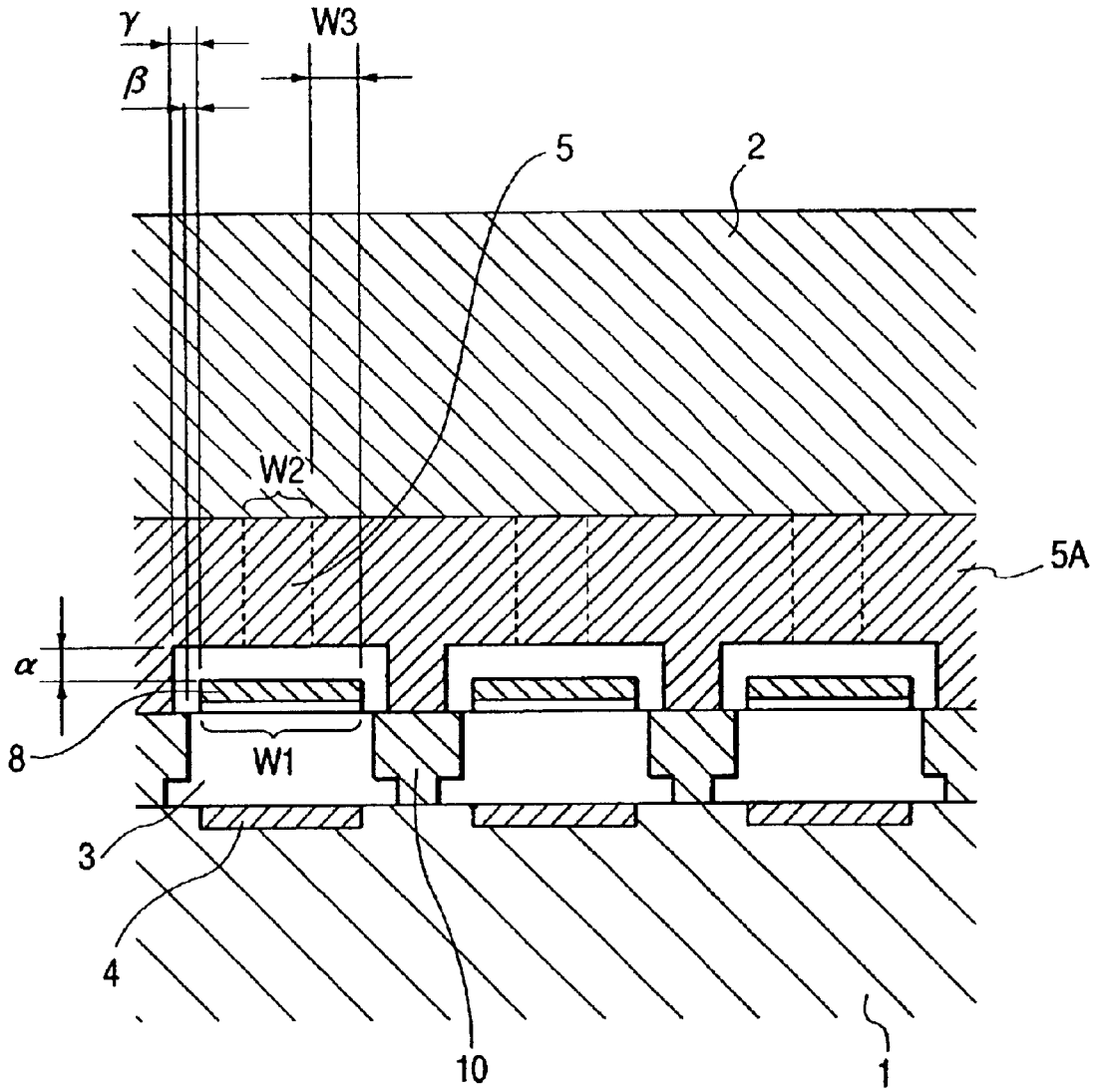
FIG. 2 is a cross-sectional view taken along line 2—2 in FIG. 1.
Figure 3:
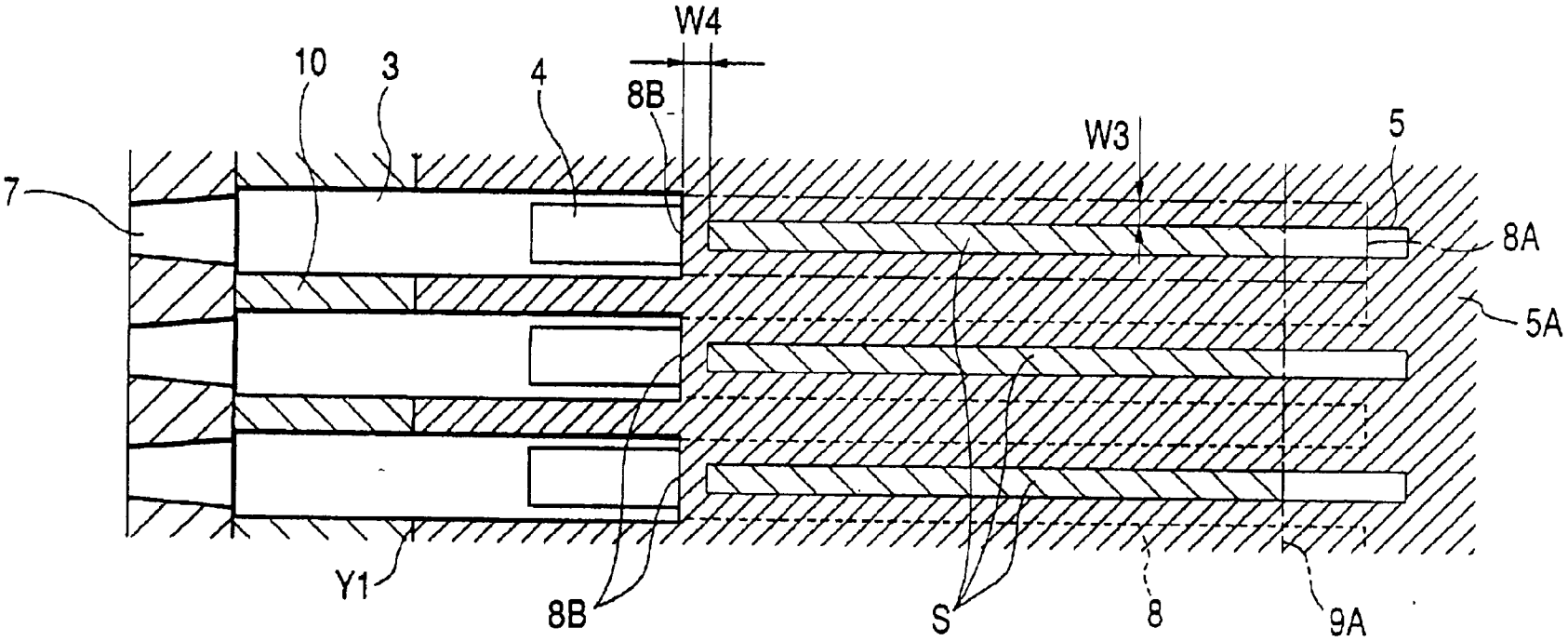
FIG. 3 is a cross-sectional view taken along line 3—3 in FIG. 1.

FIG. 1 is a cross-sectional view which shows a liquid discharge head in accordance with a first embodiment of the present invention, taken in the direction of one liquid flow path. FIG. 2 is a cross-sectional view taken along line 2—2 in FIG. 1. FIG. 3 is a cross-sectional view taken along line 3—3 in FIG. 1, which shows a shift from the center of the discharge port to the ceiling plate 2 side at a pint Y1.

For the liquid discharge head shown in FIG. 1 to FIG. 3, which is in the mode of plural liquid paths—a common liquid chamber, the elemental base plate 1 and the ceiling plate 2 are fixed in a state of being laminated through the liquid path side walls 10. Then, between both plates 1 and 2, a liquid flow path 3 is formed, one end of which is communicated with the discharge port 7. This flow path 3 is arranged in plural numbers for one head. Also, on the elemental base plate 1, there is arranged for each of the liquid flow paths 3, the heat generating element 4, such as electrothermal converting element, that serves as bubble generating means for generating bubble in liquid replenished in each liquid flow path 3. On the area near the surface of the heat generating element 4 to contact with discharge liquid, the bubble generating area 11 exists where discharge liquid is bubbled by the rapid heating of the heat generating element 4.

For each of many numbers of liquid flow paths 3, there is arranged the liquid supply port 5 which is formed for a supply unit formation member 5A. Then, the common liquid supply chamber 6 of a large capacity is arranged to be communicated with each of the liquid supply ports 5 at a time. In other words, the configuration is arranged so that a plurality of liquid flow paths 3 are branched from one single common liquid supply chamber 6, and ink is supplied from this common liquid supply chamber 6 in an amount corresponding to the liquid which has been discharged from the discharge port 7 communicated with each of the liquid flow paths 3.

Between the liquid supply port 5 and the liquid flow path 3, a movable member 8 is arranged substantially in parallel to the opening area S of the liquid supply port 5 with a minute gap $\alpha$ (10 $\mu$m or less, for instance) therewith. The movable member 8 is positioned to the elemental base plate 1, and also, substantially in parallel to the elemental base plate 1. Then, the end portion 8B of the movable member 8 on the discharge port 7 side is made a free end positioned on the heat generating element 4 side of the elemental base plate 1. The foot supporting member 8C which supports the foot of the movable member 8 is integrally formed with the movable member 8. The foot supporting member 8C is the member that connects and commonly supports a plurality of movable members 8 arranged side by side in the direction intersecting a plurality of liquid flow paths. A reference numeral 8A in FIG. 1 and FIG. 3 designates each of the foot portions of plural movable members 8 supported by the aforesaid foot supporting member 8C. This portion becomes the fulcrum of each movable member 8 at the time of being displaced. The foot supporting member 8C of the movable member 8 is joined and fixed onto the fixing member 9. Also, the end of the liquid flow path 3 on the side opposite to the discharge port 7 is closed with this fixing member 9. Further, a part of the foot supporting member 8C of the movable member 8 described earlier is not joined (is not fixed) to the fixing member 9. This non-fixing portion is provided with a step so as to shift the height position of the movable member 8 by one step from the fixing portion of the foot supporting member 8C to the fixing member 9. With this structure, when the movable member 8 is displaced, it becomes possible to relax the concentration of stress on the bonding interface of the foot supporting member 8C of the movable member 8 and the fixing member 9.

Further, for the present embodiment, the area surrounded at least by the free end portion and the both side portions of the movable member 8 that continue therefrom is made larger than the opening area S of the liquid supply port 5 (see FIG. 3), and the minute gap β is arranged between side portions of the movable member 8 and the flow path walls 10 on both sides thereof, respectively (see FIG. 2). The aforesaid supply unit formation member 5A has a gap γ with the movable member 8 as shown in FIG. 2. Although the gaps β and γ are different depending on the pitches of the flow paths, the larger the gap γ, the easier the movable member 8 is able to shield the opening area S, and the larger the gap β, the easier becomes the movable member 8 to shift to the elemental base plate 1 side along with the extinction of bubble than the steady state in which the movable member is positioned through the gap α. For the present embodiment, the gap α is 2 μm; the gap β is 3 μm; and the gap γ is 4 μm. Also, the movable member 8 has the width W1 which is larger than the width W2 of the opening area S described above in the widthwise direction between the flow path side walls 10, which is a width being able to sufficiently close the opening area S. In accordance with the present embodiment, the thickness of the portion that follows the movable member 8 of the supply unit formation member 5A is made smaller than the thickness of the liquid flow path wall 10 itself as shown in FIG. 2 and FIG. 3, and the supply unit formation member 5A is laminated on the liquid flow path walls 10. In this respect, as shown in FIG. 3, the thickness of the supply unit formation member 5A on the discharge port 7 side from the free end 8B of the movable member is set at the same thickness as the liquid path side wall 10 itself. With the arrangement thus made, while the movable member 8 can move in the liquid flow path 3 without frictional resistance, it becomes possible to regulate the displacement of the movable member to the opening area S side on the circumferential portion of the opening area S. As a result, the movable member 8 can essentially close the opening area S to make it possible to prevent the liquid flow from the interior of the liquid flow path 3 to the common liquid supply chamber 6, while the movable member 8 is made shiftable from the essentially closed state to the refillable state along with the extinction of bubble.

The opening area S referred to herein is the area where liquid is essentially supplied from the liquid supply port 5 toward the liquid flow path 3, and for the present embodiment, this opening area is the one surrounded by the three sides of the liquid supply port 5 and the edge portion 9A of the fixing member 9 as shown in FIG. 1 and FIG. 3.

Figure 4:
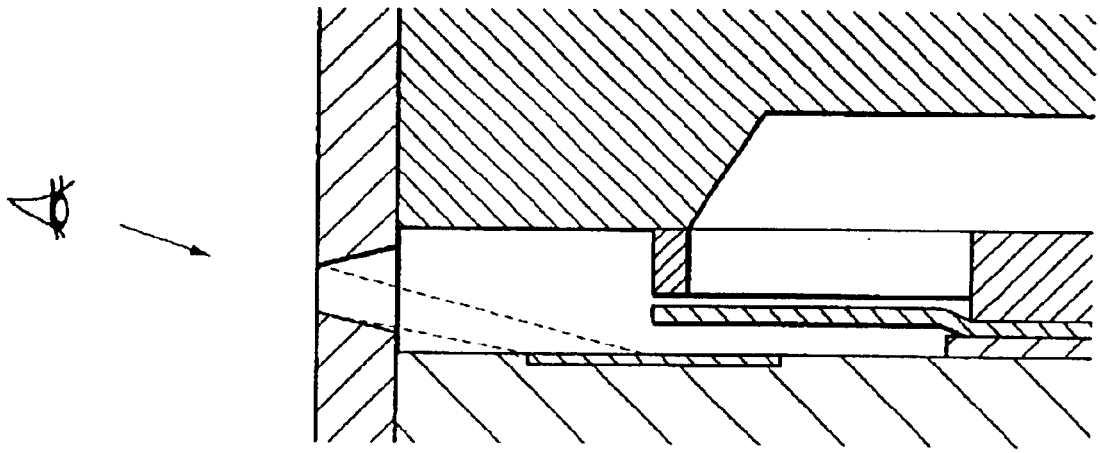
FIG. 4 is a cross-sectional view which illustrates the "linearly communicative state" of one flow path.

Also, as shown in FIG. 4, there is no obstacle, such as a valve, between the heat generating element 4 serving as the electrothermal converting member, and the discharge port 7, hence maintaining the "linearly communicative state" which is the linear flow path structure with respect to the liquid flow. More preferably, it is desirable to form the ideal state where the discharge condition, such as the discharge direction and speed of discharging droplets, is stabilized at a high level by matching the propagating direction of pressure waves generated at the time of creating bubble with the following liquid flow and discharge directions linearly. In accordance with the present invention, for the achievement of this ideal state or for the approximation thereof, it should be good enough as one of definitions if only the structure is arranged so that the discharge port 7 and the heat generating element 4, particularly the discharge port side (downstream side) of the heat generating element, which has influence on the bubble on the discharge port side, are connected directly by straight line. This state makes it possible to observe the heat generating element, the downstream side thereof, in particular, from the outer side of the discharge port if there is no liquid in the flow path (see FIG. 4).

Now, the detailed description will be made of the discharge operation of the liquid discharge head in accordance with the present embodiment. FIGS. 5A, 5B, 6A, 6B, 7A and 7B are sectional views which illustrate the discharge operation of the liquid discharge head whose structure is shown in FIGS. 1 to 3, taken along in the direction of the liquid flow path. At the same time, the characteristic phenomena are represented in the six steps in FIGS. 5A, 5B, 6A, 6B, 7A and 7B. Also, in FIGS. 5A, 5B, 6A, 6B, 7A and 7B, a reference mark M designates the meniscus formed by discharge liquid.

Figure 5A:
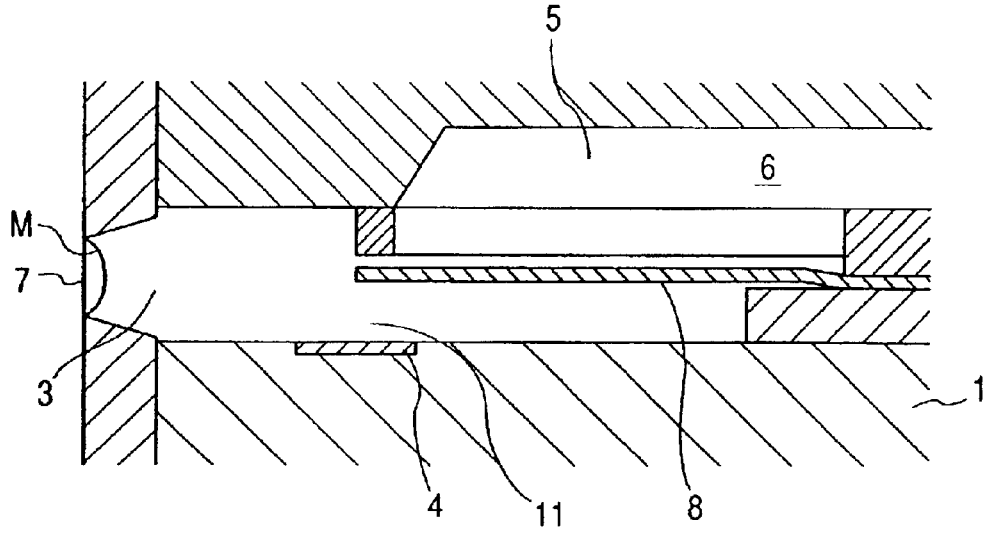
FIGS. 5A and 5B are cross-sectional views which illustrate the discharge operation of the liquid discharge head the structure of which is shown in FIGS. 1, 2 and 3, taken in the direction of the liquid flow path, while representing the characteristic phenomenon thereof.

FIG. 5A shows the state before energy, such as electric energy, is applied to the heat generating element, where no heat is generated by the heat generating element. In this state, a minute gap (10 μm or less) exists between the movable member 8 installed between the liquid supply port 5 and the liquid flow path 3, and the formation surface of the liquid supply port 5.

Figure 5B:
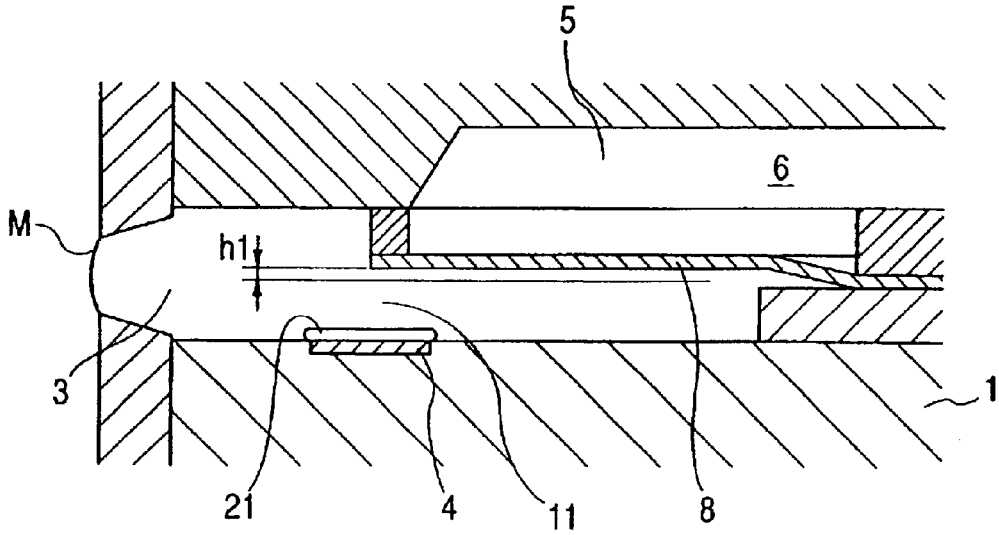

FIG. 5B shows the state where a part of liquid filled in the liquid flow path 3 is heated by the heat generating element 4, and film boiling occurs on the heat generating element 4 to enable bubble 21 to grow isotropically. Here, the "isotropic growth of bubble" means the state where each of the bubble growing velocities is substantially equal on any position of the surface of the bubble directed toward the vertical line of the bubble surface.

In the isotropically growing step of the bubble 21 at the bubbling initiation, the movable member 8 closes the liquid supply port 5 by being closely in contact with the circumference of the liquid supply port 5, and the interior of the liquid flow path 3 becomes essentially closed with the exception of the discharge port 7. This closed condition is maintained in some period in the isotropical growing step of the bubble 21. Here, the period during which the closed condition is maintained may be the one from the application of driving voltage to the heat generating element 4 to the termination of the isotropical growing step of the bubble 21. Also, in this closed state, the inertance (hardness of movement when liquid moves from its stationary condition) on the liquid supply port side from the center of the heat generating element 4 in the liquid flow path 3 becomes essentially infinite. At this juncture, the inertance from the heat generating element 4 to the liquid supply port side is closer to infinity if the distance becomes more between the heat generating element 4 and the movable member 8. Here, also, the maximum amount is defined as h1 for the free end of the movable member 8 displaced to the liquid supply port 5 side.

Figure 6A:
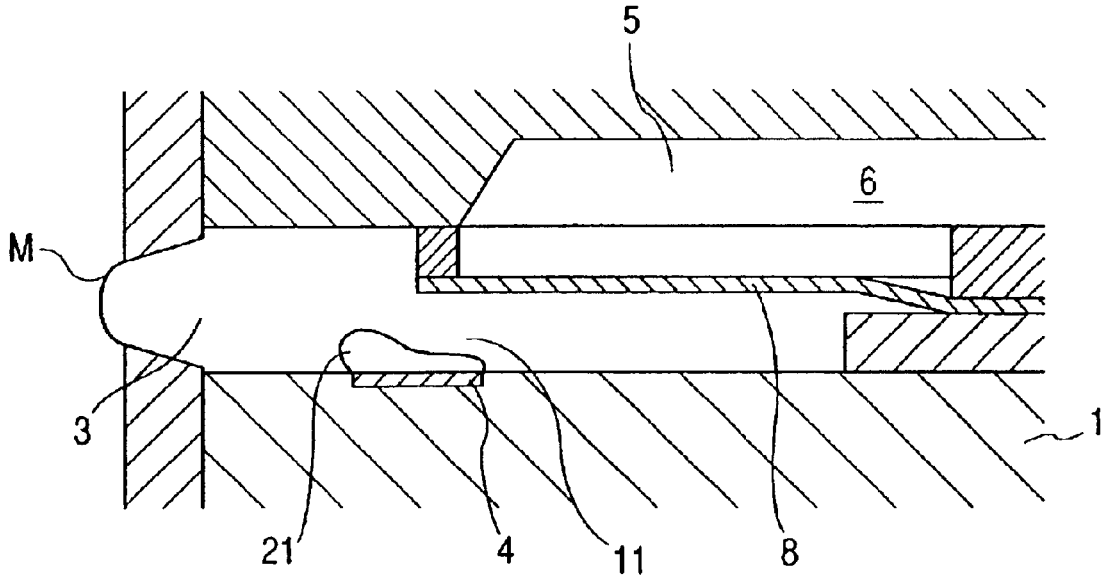
FIGS. 6A and 6B are cross-sectional views which illustrate the discharge operation of the liquid discharge head in continuation of the representations in FIGS. 5A and 5B, taken in the direction of the liquid flow path.

FIG. 6A shows the state where the bubble 21 continues to be grown. In this state, since the interior of the liquid flow path 3 is essentially closed with the exception of the discharge port 7 as described above, liquid does not flow to the liquid supply port 5 side. Therefore, the bubble can be developed greatly to the discharge port 7 side, but not allowed to develop considerably to the liquid supply port 5 side. Then, the bubble is continuously grown on the discharge port 7 side of the bubble generating area 11. On the contrary, however, the bubble growth is suspended on the liquid supply port 5 side of the bubble generating area 11. In other words, this suspended condition of bubble growth presents the maximum bubbling state on the liquid supply port 5 side of the bubble generating area 11. The bubbling volume at this juncture is defined as Vr.

Figure 8A:
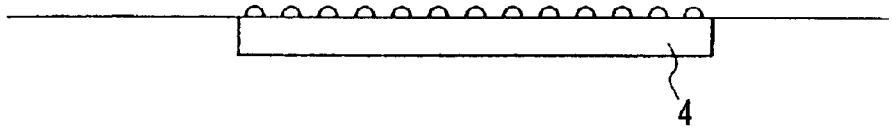
FIGS. 8A, 8B, 8C, 8D and 8E are views which illustrate the state in which the bubble shown in FIG. 5B is being grown isotropically.
Figure 8B:
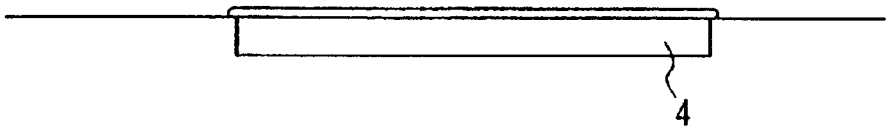
Figure 8C:
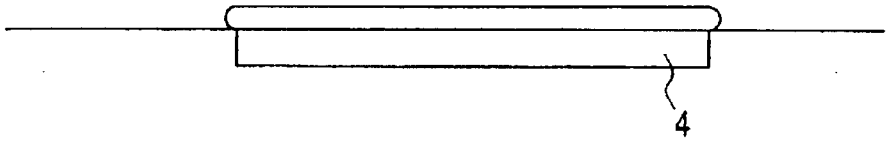
Figure 8D:
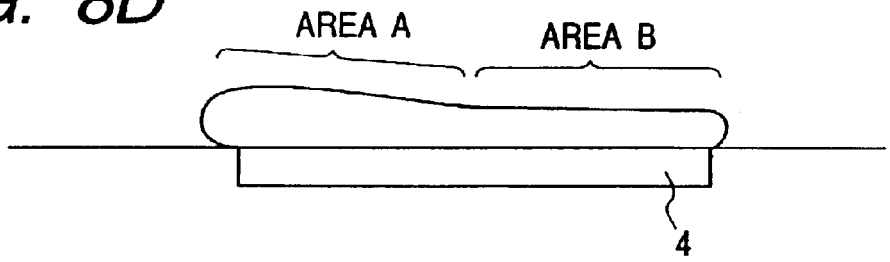
Figure 8E:
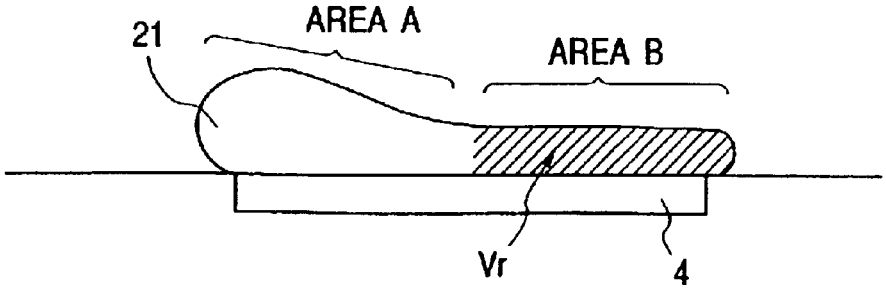

Here, in conjunction with FIGS. 8A to 8E, the detailed description will be made of the growing steps of bubble in FIGS. 5A, 5B and 6A. As shown in FIG. 8A, the initial boiling occurs on the heat generating element when the heat generating element is heated. After that, as shown in FIG. 8B, this boiling changes into the film boiling where the filmed bubble covers over the heat generating element. Then, as shown in FIGS. 8B and 8C, the bubble in the form of film boiling continues to be grown isotropically (the condition in which the bubble is isotropically grown is called "semi-purlieu condition"). However, as shown in FIG. 5B, when the interior of the liquid flow path 3 is essentially closed with the exception of the discharge port 7, liquid on the upstream side is no longer able to move. As a result, a part of the bubble on the upstream side (on the liquid supply port side) cannot be bubbled to grow in the semi-purlieu condition. The remaining portion on the downstream side (discharge port side) is grown largely. FIGS. 6A, 8D and 8E represent this state.

Here, when the heat generating element 4 is being heated, the area where no bubble is grown on the heat generating element 4 is defined as area B for the convenience sake of the description, and the area on the discharge port 7 side where the bubble is grown is defined as area A. In this respect, the bubbling volume becomes maximum in the area B shown in FIG. 8E. The bubbling volume at this time is defined as Vr.

Figure 6B:
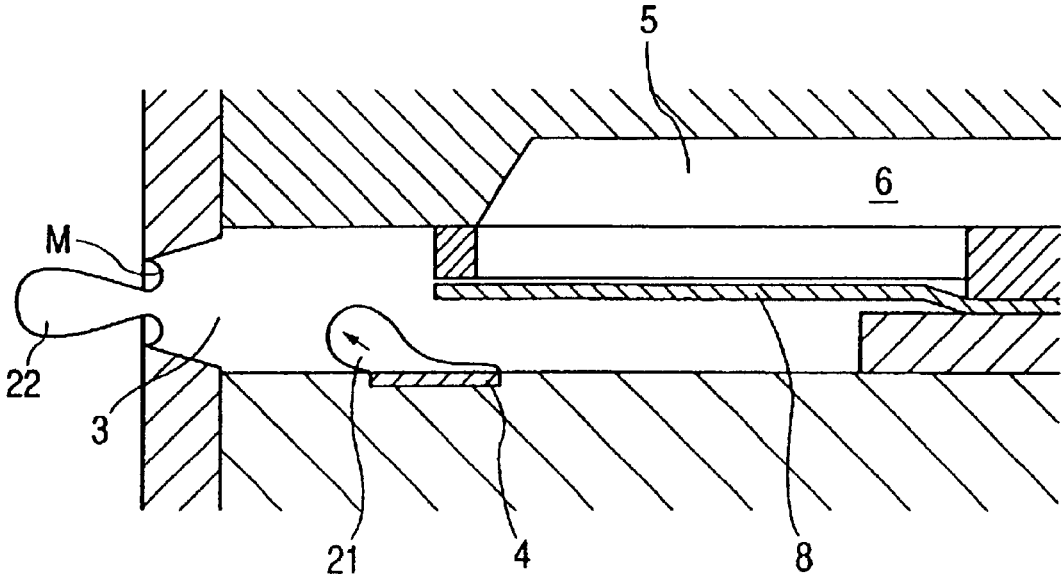

Now, FIG. 6B shows the state where the bubble continuously grows in the area A, and the bubble shrinkage begins in the area B. In this state, the bubble grows greatly toward the discharge port side in the area A, the volume of bubble begins to be reduced in the area B. Then, the free end of the movable member 8 begins to be displaced downward to the regular position due to the restoring force of the rigidity thereof and the debubbling power of the bubble in the area B. As a result, the liquid supply port 5 is open to enable the common liquid supply chamber 6 and the liquid flow path 3 to be communicated.

Figure 7A:
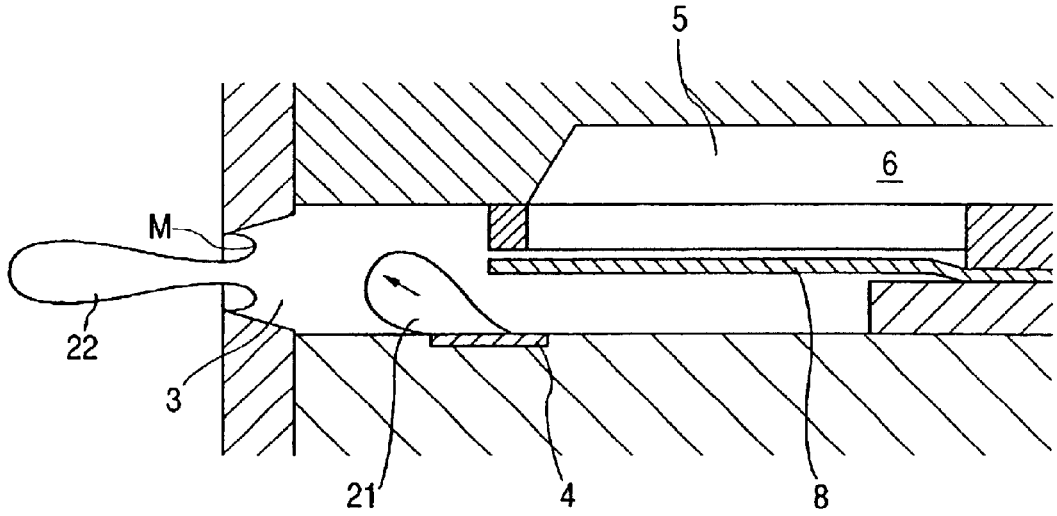
FIGS. 7A and 7B are cross-sectional views which illustrate the discharge operation in continuation of the representations in FIGS. 6A and 6B.

FIG. 7A shows the state where the bubble 21 has grown almost to the maximum. In this state, the bubble has grown to the maximum in the area A, and along with this, almost no bubble exists in the area B. The maximum bubble volume in the area A then is defined as Vf. Also, the discharge droplet 22 which is being discharged from the discharge port 7 is in a state of trailing its long tail and still connected with the meniscus M.

Figure 7B:
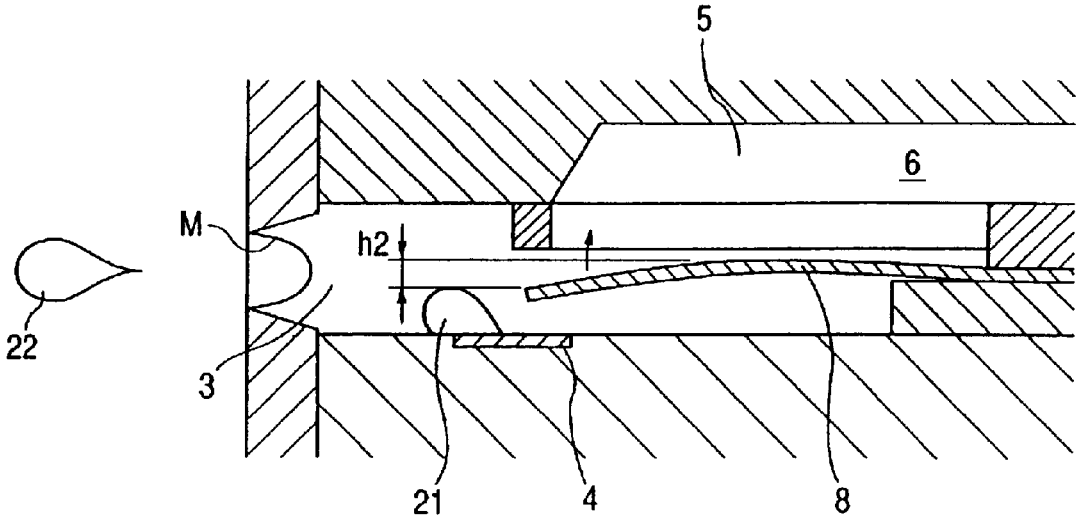

FIG. 7B shows the step in which the growth of the bubble 21 is suspended, and only debubbling process takes place, and shows the state where the discharge droplet 22 and the meniscus M has been cut off. Immediately after the bubble growth has changed into debubbling in the area A, the shrinking energy of the bubble 21 acts as the power that enables liquid residing in the vicinity of the discharge port 7 to shift in the upstream direction as keeping the entire balance. Therefore, the meniscus M is then drawn into the liquid flow path 3 from the discharge port 7, and the liquid column which is connected with the discharge droplet 22 is cut off quickly with a strong force. On the other hand, the movable member 8 is displaced downward along with the shrinkage of the bubble, and then, liquid is allowed to flow into the liquid flow path 3 as a rapid and large flow from the common liquid supply chamber 6 through the liquid supply port 5. In this way, the flow that draws the meniscus M into the liquid flow path 3 rapidly is made slower quickly, and the amount of the meniscus M retraction is reduced, and at the same time, the meniscus M begins to return to the position before bubbling at a comparatively slow speed. Consequently, as compared with the liquid discharge method which is not provided with the movable member of the present invention, the converging capability becomes extremely favorable with respect to the vibration of meniscus M. In this respect, the free end of the movable member 8 is displaced to the maximum to the bubble generating area 11 side at this time is defined as h2.

Lastly, when the bubble 21 is completely extinguished, the movable member 8 also returns to the regular position shown in FIG. 5A. The movable member 8 is displaced upward to this state by the elastic force thereof (the direction indicated by a solid line arrow mark in FIG. 7B). Also, in this sate, the meniscus M has already returned to the vicinity of the discharge port 7.

Figure 9:
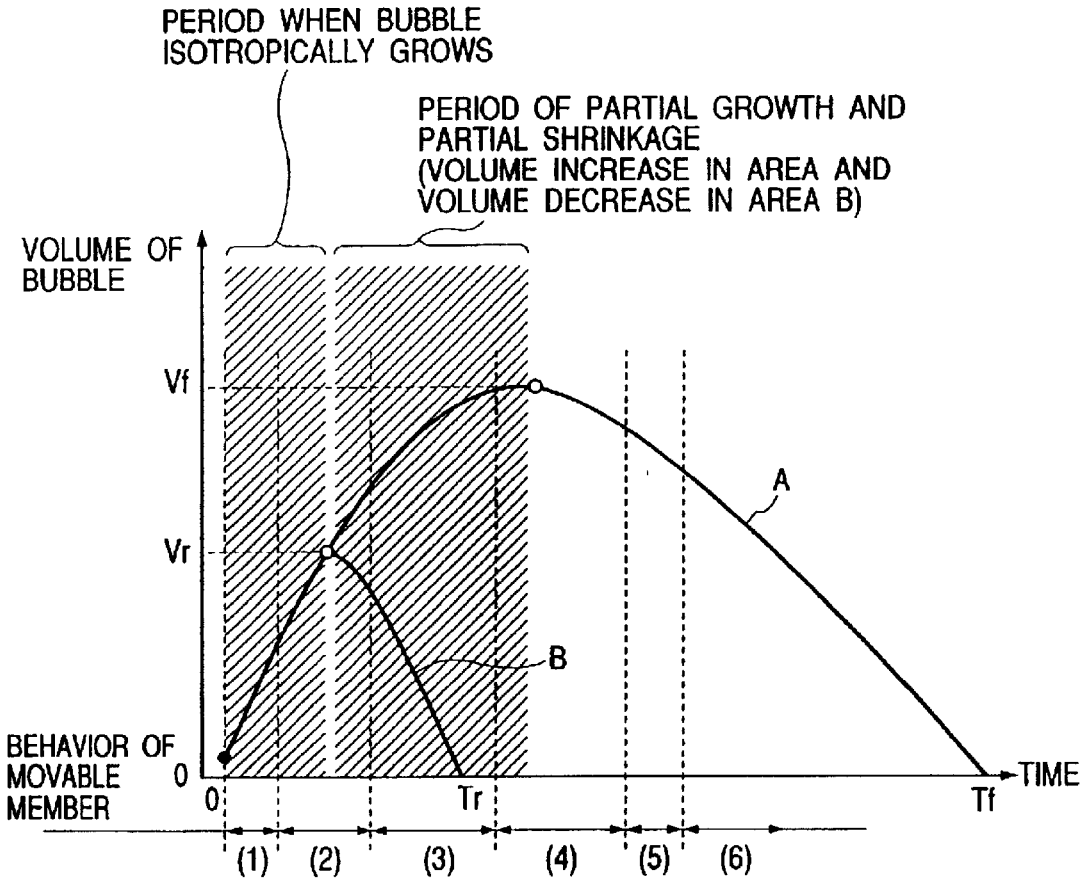
FIG. 9 is a graph which shows the correlation between the temporal changes of bubble growth and the behavior of movable member in the area A and area B represented in FIGS. 5A, 5B, 6A, 6B, 7A and 7B.

Now, with reference to FIG. 9, the description will be made of the correlation between the temporal changes of bubbling volumes and the behaviors of the movable member in the area A and area B in FIGS. 5A, 5B, 6A, 6B, 7A and 7B. FIG. 9 is a graph shows the correlation, and the curved lane A indicates the temporal changes of bubbling volumes in the area A, and the curved line B indicates the temporal changes of the bubbling volumes in the area B.

As, shown in FIG. 9, the temporal changes of growing volumes of bubble in the area A draws a parabola having the maximum value. In other words, during the period from the initiation of bubbling to the extinction thereof, the bubbling volumes increase as the time elapses to reach its maximum at a certain point, and then, decrease thereafter. On the other hand, in the area B, the time required for the bubbling initiation to its extinction is shorter as compared with the case of area A, and also, the maximum volume of the bubble growth is smaller. It takes also shorter period to reach the maximum volume of its growth. That is, there is a great difference between the area A and area B as to the time required for bubble initiation and its extinction, as well as in the changes of growing values of bubble. These are smaller in the area B.

Particularly, in FIG. 9, the bubbling volume increases at the same temporal changes in the initial stage of bubble generation. Therefore, the curved line A and curved line B are overlapped, that is, the period occurs during which the bubble grows isotropically in the initial stage of bubble generation (presenting the semi-purlieu condition). After that, the curved line A draws a curve with which it reaches the maximum point, but at a certain point, the curved line B branches out from the curved line A to draw a line with which the bubbling volumes are reduced in the area B (presenting the period during which a partial shrinkage occurs in the growing portion), although the bubbling volume increases in the area A.

Now, in accordance with the devise of bubble growth described above, the movable member presents the behavior given below in a mode where a part of the heat generating element is covered by the free end of the movable member as shown in FIG. 1. In other words, during the period (1) in FIG. 9, the movable member is displaced upward toward the liquid supply port. During the period (2) in FIG. 9, the movable member is closely in contact with the liquid supply port, and the interior of the liquid flow path is essentially closed with the exception of the discharge port. In this closed condition begins during the period when the bubble grows isotropically. Then, during the period (3) in FIG. 9, the movable member is displaced downward toward the position of regular condition. The releasing of the liquid supply port by this movable member begins with the initiation of the partial shrinkage of the growing portion after a specific period of time has elapsed. Then, during the period (4) in FIG. 9, the movable member is displaced further downward from the regular condition. Then, during the period (5) in FIG. 9, the downward displacement of the movable member is almost suspended to make the movable member to be in the equilibrium condition in the released position. Lastly, during the period (6) in FIG. 9, the movable member is displaced upward to the position of the regular condition.

Such correlation as this between the bubble growth and the behavior of the movable member is influenced by the relative positions of the movable member and the heat generating element. Here, with reference to FIGS. 10A, 10B, 11A and 11B, the description will be made of the correlation between the bubble growth and the behavior of the movable member of a liquid discharge head provided with the movable member and heat generating element whose relative positions are different from those of the present embodiment.

Figure 10A:
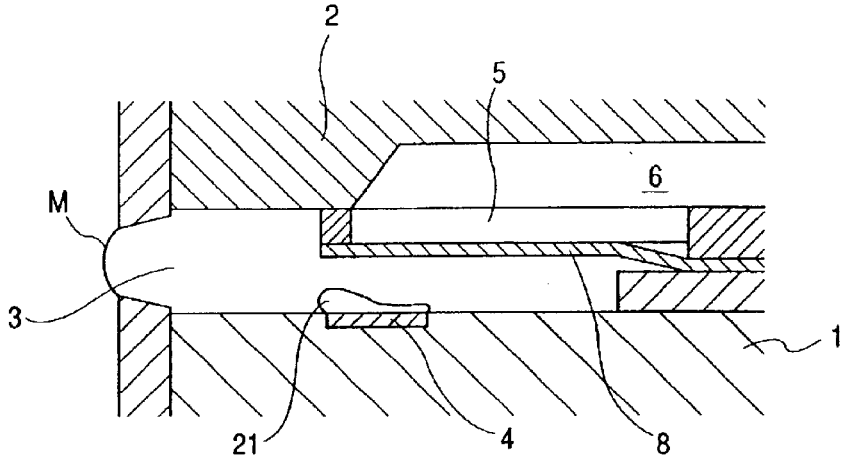
FIGS. 10A and 10B are view and graph which illustrate a liquid discharge head having a different mode from the relative positions of the movable member and heat generating element shown in FIG. 1, and the correlation between the temporal changes of bubble growth and the behavior of movable member.
Figure 10B:
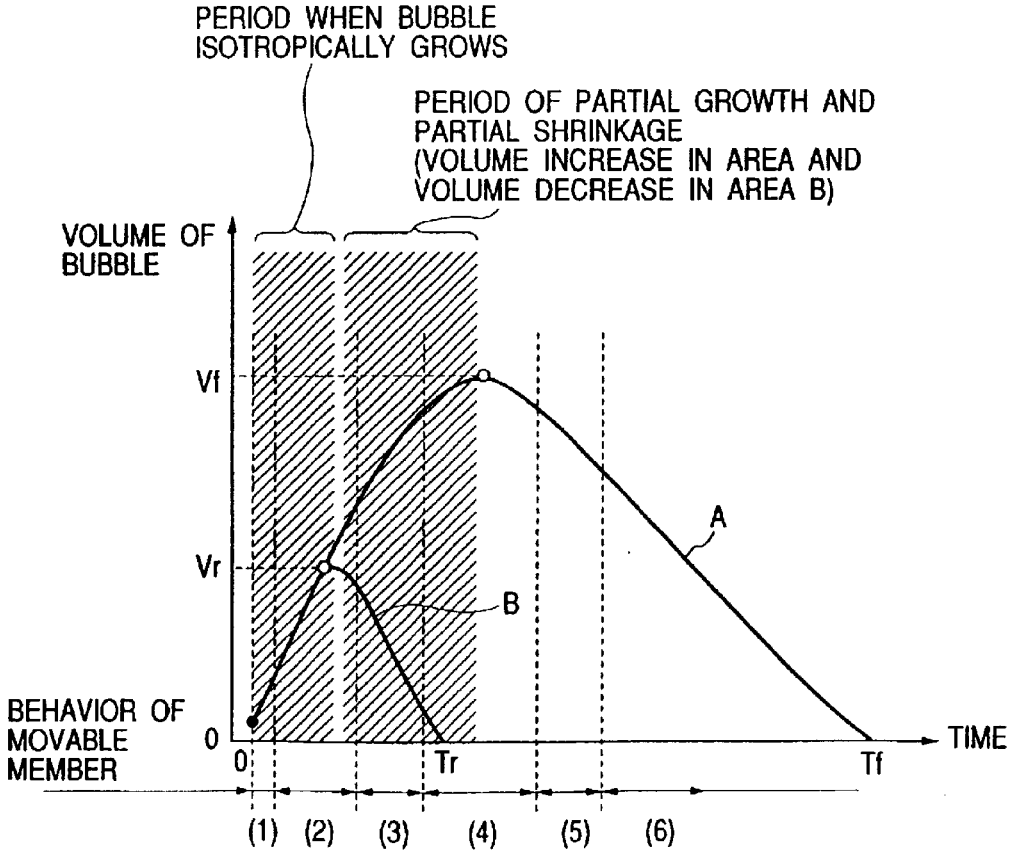

FIGS. 10A and 10B are views which illustrate the correlation between the bubble growth and the behavior of the movable member in the mode where the free end of the movable member covers the entire body of the heat generating element. FIG. 10A shows the mode thereof. FIG. 10B is a graph that shows the correlation between them. If the area where the heat generating element and the movable member are overlapped is large as in the mode shown in FIG. 10A, the period (1) in FIG. 10B becomes shorter than the case of the mode shown in FIG. 1, and the closed state represents in a shorter period of time since the heat generating element is heated, hence making it possible to enhance the discharge efficiency still more. In this respect, the corresponding behaviors of the movable member in each of the periods (1) to (6) in FIG. 10B are the same as those described in conjunction with FIG. 9. Also, with the mode shown in FIG. 10A, it becomes easier for the movable member to be influenced by the reduction of the bubbling volume. Then, as clear from the representation of the initiation of the period (3) in FIG. 10B, the initiation of releasing the liquid supply port by the movable member takes place immediately after the initiation of the partial shrinkage of growing portion of the bubble. In other words, the releasing timing of the movable member becomes quicker than the mode shown in FIG. 1. For the same reasons, the amplitude of the movable member 8 becomes greater.

Figure 11A:
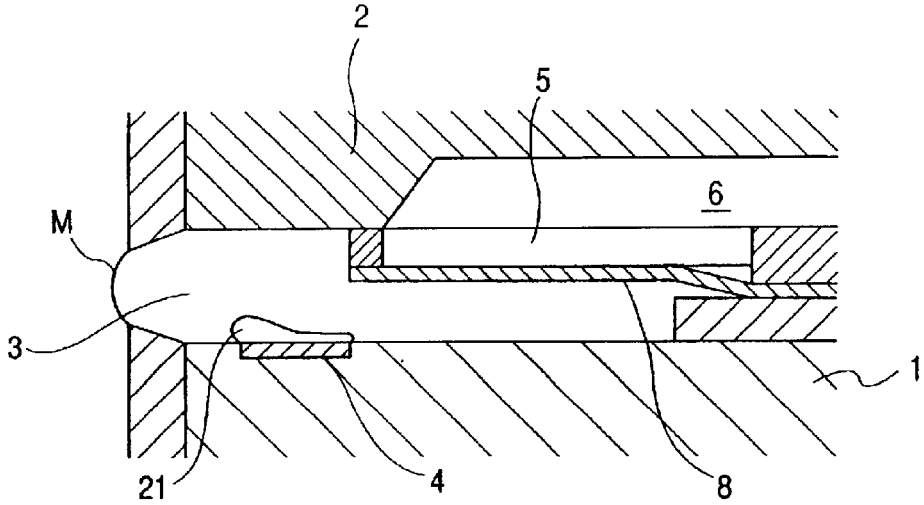
FIGS. 11A and 11B are view and graph which illustrate a liquid discharge head having a different mode from the relative positions of the movable member and heat generating element shown in FIG. 1, and the correlation between the temporal changes of bubble growth and the behavior of movable member.
Figure 11B:
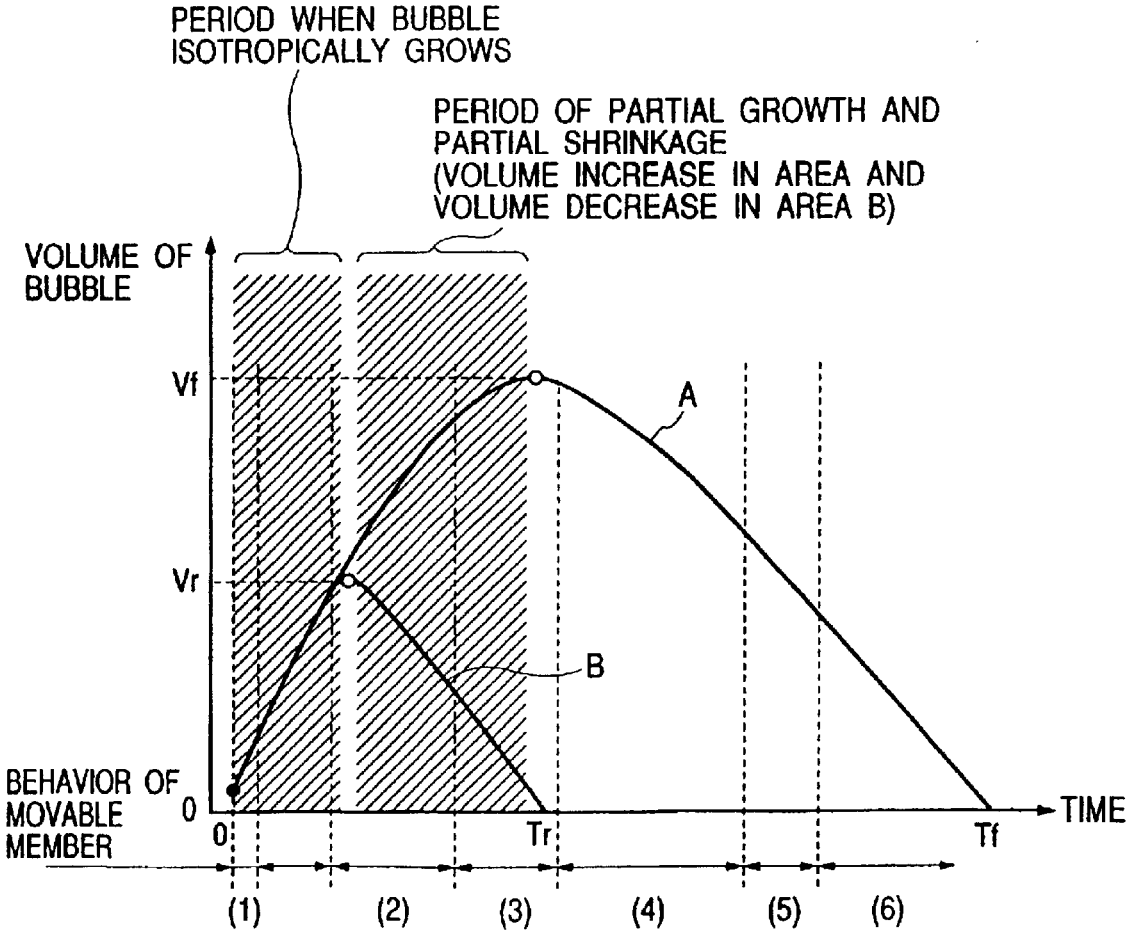

FIGS. 11A and 11B are views which illustrate the bubble growth and the behavior of the movable member in the mode where heat generating element and the movable member are apart from each other. FIG. 11A shows such mode, FIG. 11B is a graph showing the correlation between them. If the heat generating element is apart from the movable member as in the mode shown in FIG. 11A, the movable member is not easily influenced by the reduction of bubbling volume. Therefore, as clear from the initiation point of the period (3) in FIG. 11B, the releasing initiation of the liquid supply port by the movable member is considerably delayed from the initiation period of the partial shrinkage of the growing portion. In other words, the releasing timing of the movable member is slower than the mode shown in FIG. 1. For the same reasons, the amplitude of the movable member becomes smaller. In this respect, the behaviors of the movable member in each of the periods from (1) to (6) in FIG. 11B are the same as those described in conjunction with FIG. 9.

In this respect, the general operation has been described as to the positional relations between the movable member 8 and the heat generating element 4, and the respective operations become different depending on the position of the free end of the movable member, and the rigidity of the movable member, among some others.

Also, as understandable form the representation of FIGS. 9, 10A, 10B, 11A and 11B, the relationship of Vf>Vr is always established for the head of the present invention where the maximum volume of bubble (the bubble in the area A) which grows on the discharge port 7 side of the bubble generating area 11 is given as Vf, and the maximum volume of bubble (the bubble in the area B) which grows on the liquid supply port 5 side of the bubble generating area 11 is given as Vr. Further, the relationship of Tf>Tr is always established for the head of the present invention where the life time (the time from the generation of bubble to the extinction thereof) of the bubble (the bubble in the area A) which grows on the discharge port 7 side of the bubble generating area 11 is given as Tf, and the life time of bubble (the bubble in the area B) which grows on the liquid supply port 5 side of the bubble generating area 11 is given as Tr. Then, in order to establish the aforesaid relationship, the bubble extinction point is positioned on the discharge port 7 side from the central portion of the bubble generating area 11.

Further, as understandable form FIG. 5B and FIG. 7B, with the structure of the head hereof, the maximum displacement amount h2, in which the free end of the movable member 8 is displaced to the bubble generating means 4 side along with the extinction of bubble, is greater than the maximum displacement amount h1, in which the free end of the movable member 8 is displaced to the liquid supply port 5 side during the initiation period of bubble creation, that is, the relationship of (h1<h2) is presented. For example, the h1 is 2 $\mu$m, and the h2 is 10 $\mu$m. With the relationship established as described above, it becomes possible to suppress the bubble growth toward the rear side of the heat generating element (in the direction opposite to the discharge port), while promoting the bubble growth toward the front side of the heat generating element (in the direction toward the discharge port). With the establishment of this relationship, it becomes possible to enhance the efficiency of converting the bubbling power generated by the heat generating element into the kinetic energy whereby to fly liquid from the discharge port as liquid droplet.

The head structure of the present embodiment and the liquid discharge operation thereof have been described as above. In accordance with the embodiment, the growing component of the bubble to the downstream side and the growing component thereof to the upstream side are not even, and the growing component to the upstream side becomes almost none, hence suppressing the liquid shift to the upstream side. With this suppression of liquid flow to the upstream side, there is almost no loss that may be incurred on the growing component of bubble on the upstream side. Most of all the components thereof are directed toward the discharge port, and enhance the discharging power significantly. Moreover, along with the shrinkage of bubble, the movable member is displaced downward to enable liquid to flow into the liquid flow path as a rapid and large liquid flow from the common liquid supply chamber through the liquid supply port. As a result, the flow that tends to draw the meniscus M into the liquid flow path 3 rapidly is made smaller at once. Then, the retracted amount of meniscus after discharge is reduced, and the degree of meniscus to be projected from the orifice surface is also reduced accordingly at the time of refilling. This contributes to suppressing the vibrations of meniscus, thus stabilizing liquid discharges at any driving frequency, lower to higher ones.

(Second Embodiment)

Figure 12:
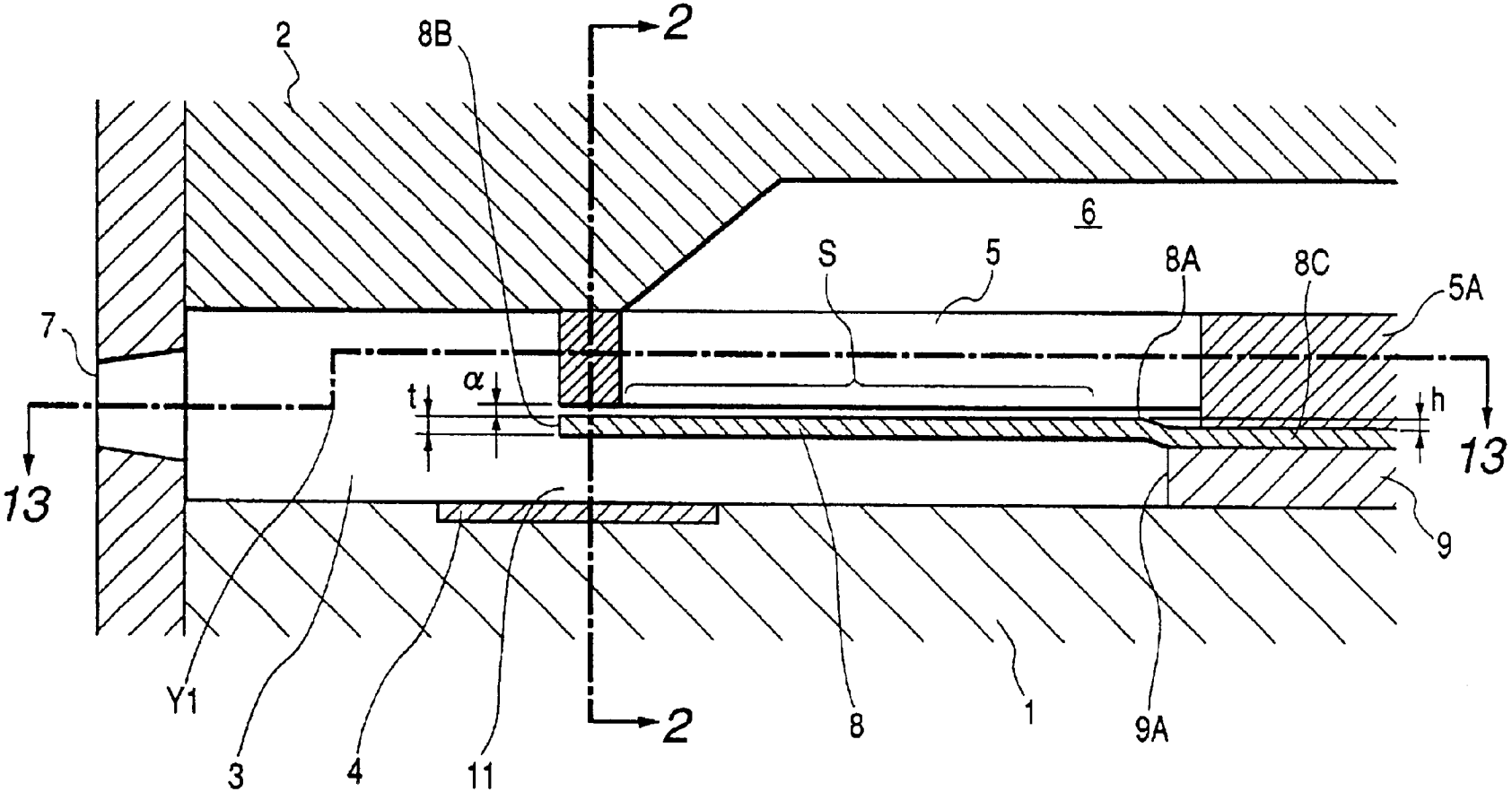
FIG. 12 is a cross-sectional view which shows a liquid discharge head in accordance with a first variational example of the second embodiment of the present invention, taken in the direction of one liquid flow path.
Figure 13:
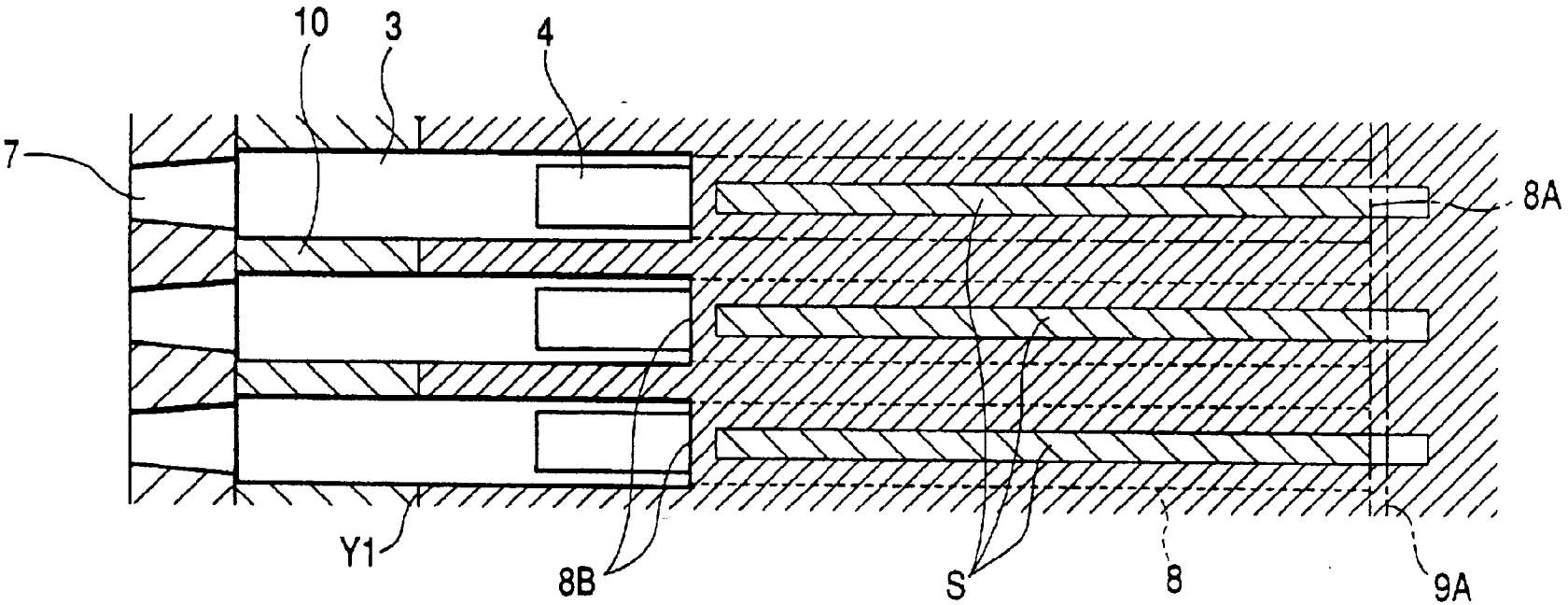
FIG. 13 is a cross-sectional view taken along line 13—13 in FIG. 12.

For the head structure of the first embodiment, the position of the foot supporting member 8C of the movable member 8, which is not to be in contact with the fixing member 9 (that is, bent to rise) as shown in FIGS. 1 to 3, is not the same as the edge portion 9A of the fixing member 9. Therefore, the opening area S becomes the area surrounded by the three sides of the liquid supply port 5 and the edge portion 9A of the fixing member 9. However, as shown in FIGS. 12, 13, it may be possible to adopt a mode in which the position of the foot supporting member 8C of the movable member 8 being bent to rise from the fixing member 9 is set at the edge portion 9A of the fixing member 9. In the case of this mode, the opening area S becomes the area surrounded by the three sides of the liquid supply port 5 and the fulcrum 8A of the movable member 8 as shown in FIGS. 12 and 13.

Figure 14:
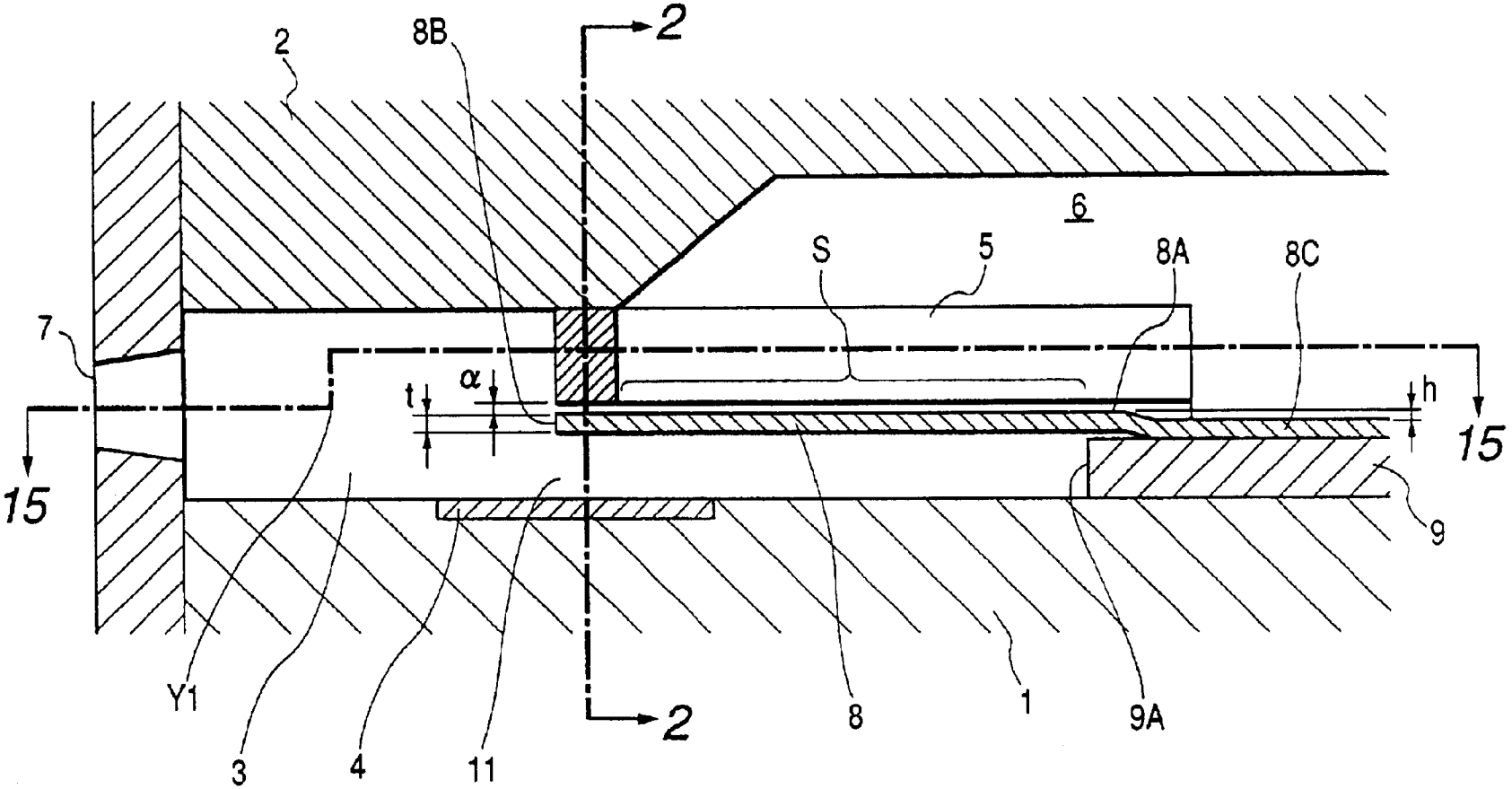
FIG. 14 is a cross-sectional view which shows a liquid discharge head in accordance with a second variational example of the second embodiment of the present invention, taken in the direction of one liquid flow path.
Figure 15:
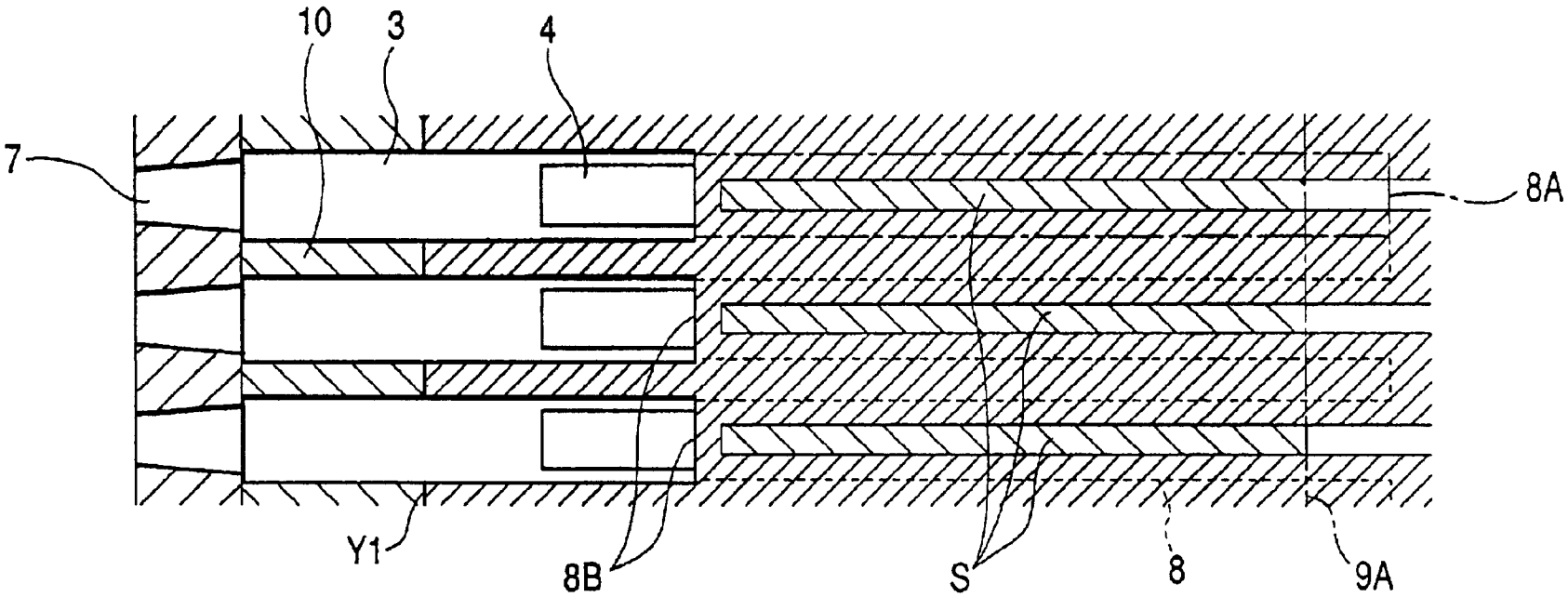
FIG. 15 is a cross-sectional view taken along line 15—15 in FIG. 14.

Also, as shown in FIG. 3, the liquid supply port 5 is arranged to be an opening surrounded by four wall faces in accordance with the head structure of the first embodiment. However, as shown in FIGS. 14 and 15, it may be possible to adopt a mode to release the wall face of the supply unit formation member 5A (see FIG. 1) on the liquid supply chamber 6 side, which is opposite to the discharge port 7 side. In the case of this mode, the opening area S becomes, as shown in FIGS. 14 and 15, the area surrounded by the three side of the liquid supply port 5 and the edge portion 9A of the fixing member 9 as in the first embodiment.

In this respect, the linearly sectional view of 2—2 in FIG. 12 and the linearly sectional view of 2—2 FIG. 14 is the same as FIG. 2.

(Third Embodiment)

Further, for each of the embodiments described above, it is more preferable to make the thickness t of the movable member 8 larger than the stepping amount h of the foot supporting member 8C of the movable member 8 as shown in FIGS. 1, 12, or FIG. 14, for example. Here, it is arranged to set the t=5 $\mu$m, and the h=2 $\mu$m, for example. With this arrangement, it becomes possible to relax the stress concentration which is concentrated on the stepping portion of the foot supporting member 8C of the movable member 8 when the movable member 8 is displaced, hence improving the durability of the foot portion of the movable member 8.

Figure 16:
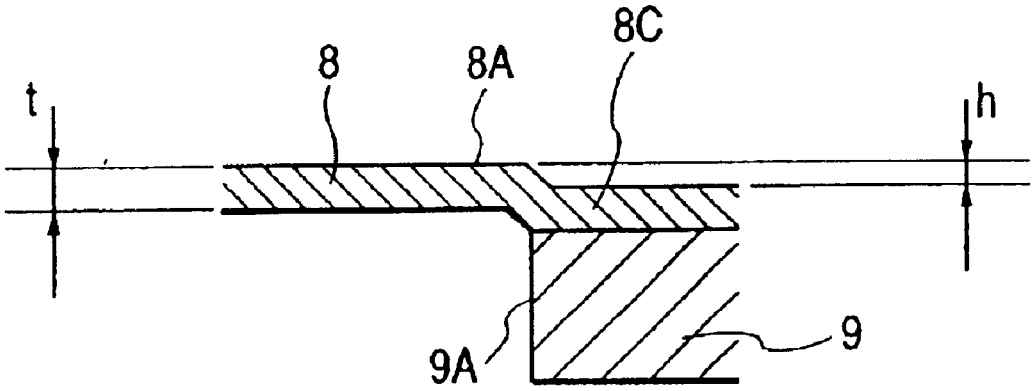
FIG. 16 is an enlarged sectional view which shows the circumference of the foot portion of the movable member in the head structure represented in FIG. 12.
Figure 17:
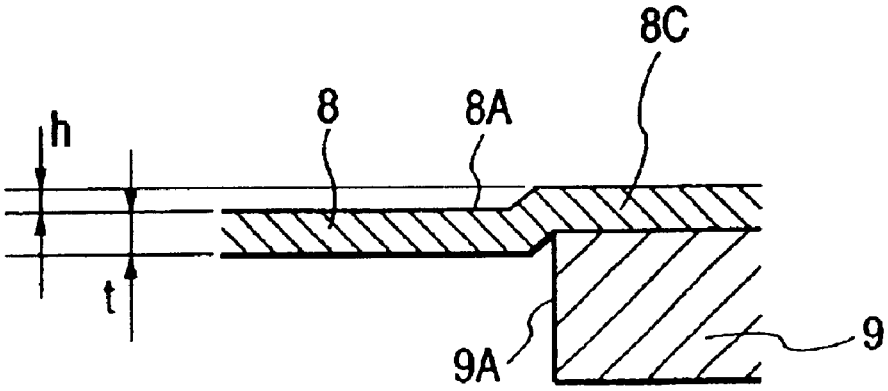
FIG. 17 is a cross-sectional view which shows the variational example of the movable member represented in FIG. 16.

Also, FIG. 16 is an enlarged sectional view which shows the circumference of the foot portion of the movable member in accordance with the head structure represented in FIG. 12. FIG. 17 shows the variational example of the one shown in FIG. 16.

As represented in FIG. 16, the height position of the movable member 8 for each of the embodiments described above is deviated by one step to the liquid supply port 5 side with respect to the fixing portion between the foot supporting member 8C of the movable member 8 and the fixing member 9. On the contrary thereto, however, it may be possible to adopt a mode in which such height is deviated to the heat generating element (not shown) side as shown in FIG. 17. In this mode, too, it becomes possible to improve the durability of the foot portion of the movable member 8 by making the thickness t of the movable member 8 larger than the stepping amount h of the foot supporting member 8C of the movable member 8.

(Fourth Embodiment)

Further, it is possible to enhance the discharge efficiency for each of the embodiments described above by arranging, as shown in FIG. 2, for example, the gap a between the opening edge of the liquid supply port 5 on the liquid flow path 3 side, and the movable member 8 on the liquid supply port 5 side, and the overlapping width W3 of the movable member 8 in the widthwise direction, which is overlapped with the opening edge of the liquid supply port 5 on the liquid flow path 3 side, to be in a relationship of W3>$\alpha$. Here, for example, while making the gap $\alpha$ is 2 $\mu$m, the aforesaid overlapping width W3 is set at 3 $\mu$m.

Figure 18A:
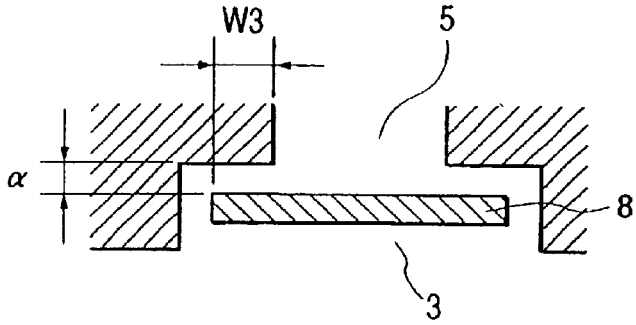
FIGS. 18A and 18B are cross-sectional views which illustrate the liquid flow at the time of bubbling initiation when the structure presents the relationship of W3>$\alpha$, taken along the liquid supply port.
Figure 18B:
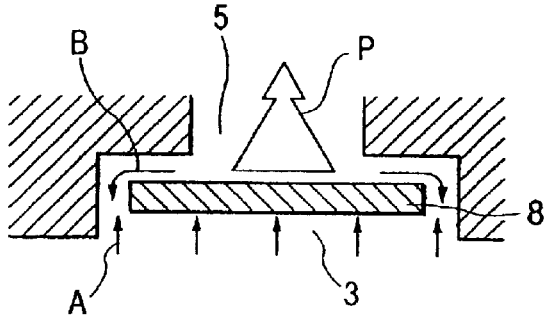

In this respect, in conjunction with FIGS. 18A, 18B, 19A and 19B, the description will be made of the liquid flow at the bubbling initiation both in the cases of the aforesaid relationship being W3>$\alpha$ and W3$\leqq\alpha$, respectively. FIGS. 18A, 18B, 19A and 19B are cross-sectional views which illustrate the flow path that runs through the liquid supply port. At first, in the relationship of W3>$\alpha$ shown in FIG. 18A, the flow indicated by an arrow A is created on the sides of the movable member 8 when the movable member 8 is displaced upward by the pressure exerted by the bubble initiation as shown in FIG. 18B. Also, the flow indicated by an arrow B is created in the gap between the movable member 8 and the opening edge of the liquid supply port 5. At this juncture, since the flow indicated by the arrow B is sufficiently large, it becomes possible to suppress the flow indicted by the arrow A with the flow indicated by the arrow B. In this way, the liquid flow P to the liquid supply port 5 side can be suppressed sufficiently, hence enhancing the discharge efficiency still more.

Figure 19A:
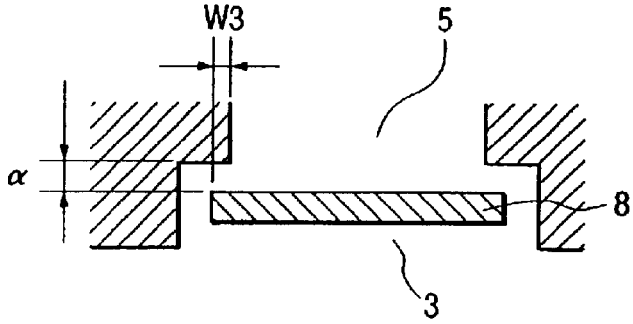
FIGS. 19A and 19B are cross-sectional views which illustrate the liquid flow at the time of bubbling initiation when the structure presents the relationship of W3$\leqq\alpha$, taken along the liquid supply port.
Figure 19B:
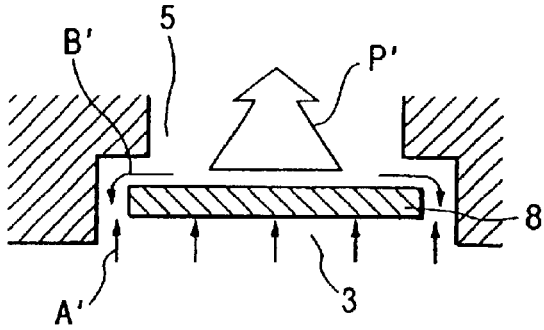

On the other hand, in the relationship of W3<$\alpha$ shown in FIG. 19A, when the movable member 8 is displaced upward by the pressure exerted by the bubbling initiation as shown in FIG. 19B, the flow indicated by an arrow A' is created on the sides of the movable member 8, and also, the flow indicated by an arrow B' is created in the gap between the movable member 8 and the opening edge of the liquid supply port 5. At this juncture, since the flow indicated by the arrow B' is not large enough, the flow indicated by the arrow B' cannot suppress the flow indicated by the arrow A' so much as the case where the relationship is W3>$\alpha$. As a result, the liquid flow P' to the liquid supply port 5 side becomes larger than the case of the W3>$\alpha$.

Therefore, if the relationship is made to be the W3>$\alpha$ as described above, the flow resistance against the flow from the liquid flow path 3 to the liquid supply port 5 side becomes higher than the case where the aforesaid relationship is W3$\leqq\alpha$, hence making it possible to sufficiently suppress the flow from the liquid flow path 3 to the liquid supply port 5 side at the time of bubbling initiation for the bubble growth. Also, it becomes possible to suppress sufficiently the flow that comes from the liquid flow path 3 to the liquid supply port 5 through the gap between the movable member 8 and the circumference of the liquid supply port 5. As a result, the liquid supply port 5 can be shielded by the movable member 8 reliably and quickly. With the occurrence of these events, the discharge efficiency can be enhanced still more.

(Fifth Embodiment)

Further, for each of the embodiments described above, it is more preferable, as shown in FIG. 3, for example, to arrange the overlapping width W4 of the movable member 8 in the direction toward the discharge port 7, which is overlapped with the opening edge of the liquid supply port 5 on the liquid flow path 3 side, and the overlapping width W3 in the widthwise direction of the movable member 8 to be W3>W4. Here, it is arranged to make the W3=3 $\mu$m, and the W4=2 $\mu$m, for example.

With the relationship thus arranged, when the movable member 8, which has been displaced upward to the liquid supply port 5 side by the bubbling initiation, begins to be displaced downward, the contact width between the leading edge of the fee end of the movable member 8 and the opening edge of the liquid supply port 6 becomes smaller. Then, the friction force generated between them is also reduced so that the liquid supply port is released priorly from free end side of the movable member. In this way, the liquid supply port is released by the movable member reliably and quickly. As a result, refilling is carried out more efficiently to stabilize the discharge characteristics still more.

Figure 20:
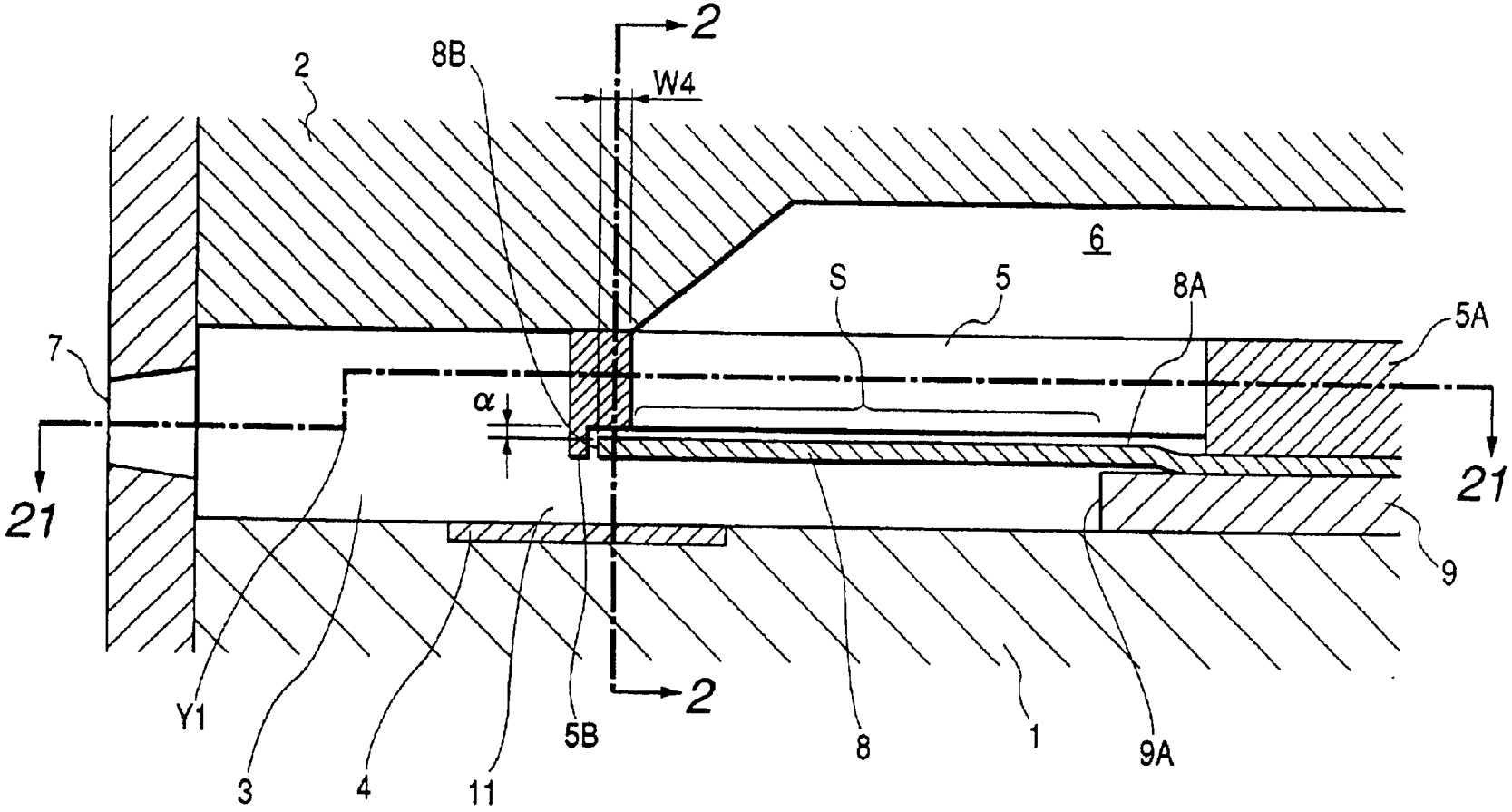
FIG. 20 is a cross-sectional view which shows a liquid discharge head in accordance with the variational example of the fifth embodiment of the present invention, taken in the direction of the one liquid flow path.
Figure 21:
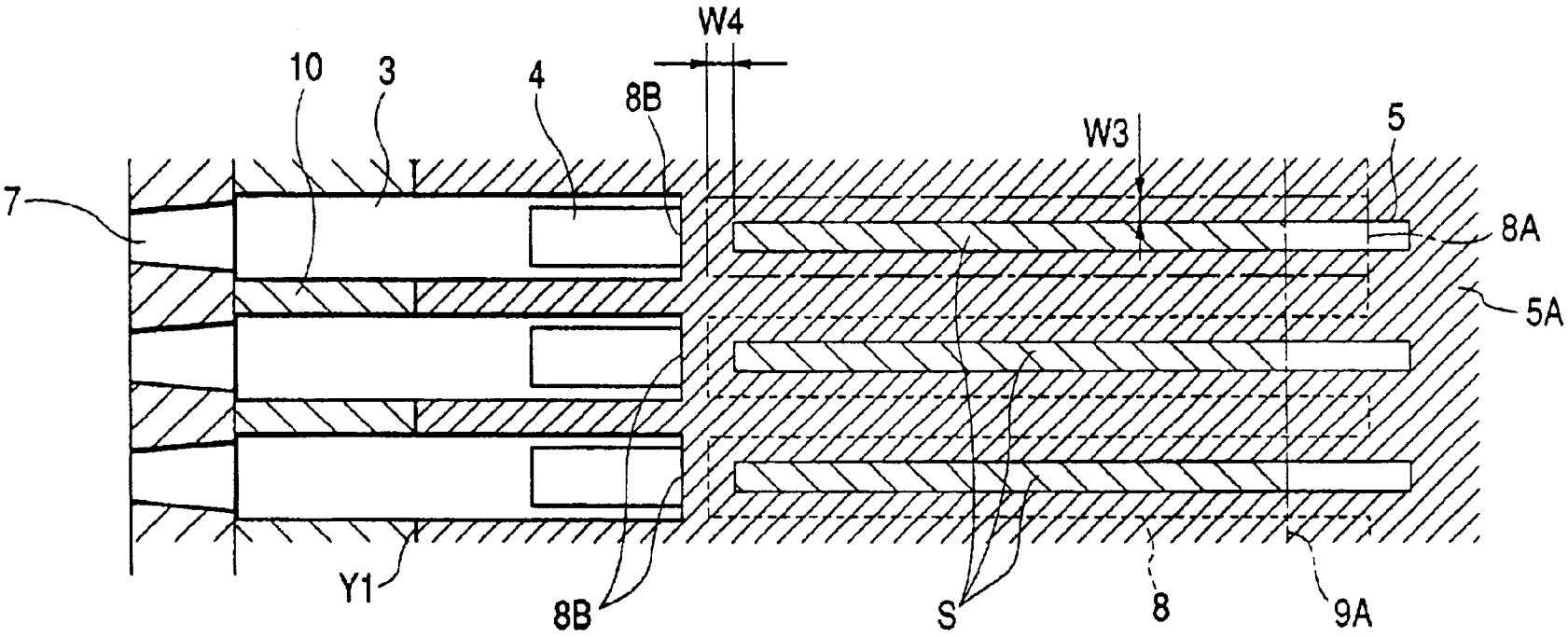
FIG. 21 is a linearly sectional view taken along line 21—21 in FIG. 20, which shows a shift from the center of the discharge port to the ceiling plate 2 side at a point Y1.
Figure 22D:
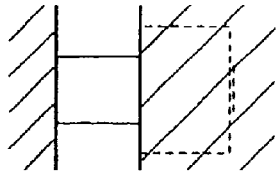
FIGS. 22A, 22B, 22C and 22D are views which illustrate a liquid discharge head in accordance with a sixth embodiment of the present invention.
Figure 22C:
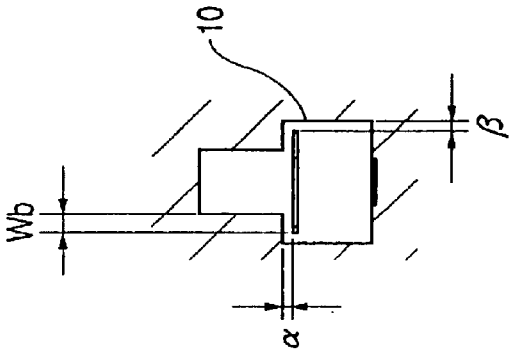
Figure 22A:
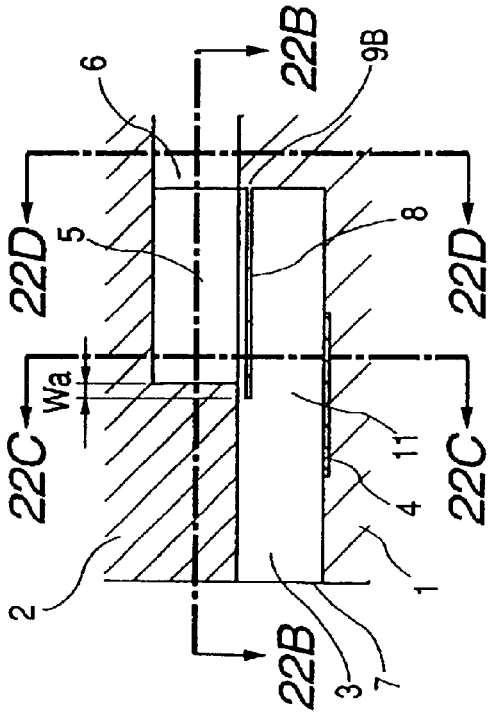
Figure 22B:
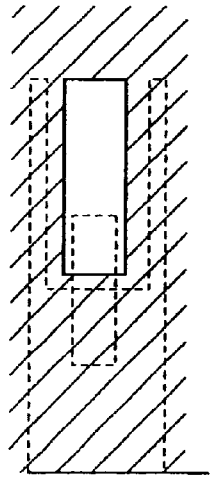

Also, FIG. 20 is a cross-sectional view which shows the variational example of the present embodiment, taken in the direction of one liquid flow path of a liquid discharge head. FIG. 21 is a cross-sectional view taken along line 21—21 in FIG. 20, which shifts from the center of the discharge port to the ceiling plate 2 side at a point Y1. Here, the linearly sectional view of 2—2 in FIG. 20 is the same as FIG. 2.

The liquid discharge head shown in FIG. 20 and FIG. 21 is such that a part of the liquid discharge head of the first embodiment is modified. As shown in FIG. 20, instead of the first embodiment, the wall face portion 5B, which is provided with a specific gap with the leading edge of the movable member 8 on the discharge port 7 side, is formed as a part of the supply unit formation member 5A. In this manner, the gap $\alpha$ between the opening edge of the liquid supply port 5 on the liquid flow path 3 side, and the face of the free end 8B of the movable member 8 on the liquid supply port 5 side is apparently covered by the wall face portion 5B when observed from the discharge port 7 toward the movable member 8. Therefore, at the bubbling initiation, it becomes possible to suppress sufficiently the flow from the liquid flow path 3 to the liquid supply port 5, which is in the direction opposite to the discharging direction. Thus, the discharge efficiency is further enhanced. Then, in this structural example, too, it is possible to release the liquid supply port by the movable member 8 reliably and quickly if, as shown in FIG. 21, the overlapping width W4 of the movable member 8 in the discharge port 7 direction, which is overlapped with the opening edge of the liquid supply port 5 on the liquid flow path 3 side, and the overlapping width W3 of the movable member 8 in the widthwise direction are arranged in a relationship of W3>W4. In this manner, the refilling is carried out more efficiently to the liquid flow path 3 so as to stabilize the discharge characteristics still more.

(Sixth Embodiment)

FIGS. 22A to 22D are views which shows a liquid discharge head in accordance with a sixth embodiment of the present invention.

For the liquid discharge head shown in FIGS. 22A to 22D, the elemental base plate 1 and the ceiling plate 2 are bonded, and between both plates 1 and 2, the flow path 3 is formed, one end of which is communicated with the discharge port 7.

The liquid supply port 5 is arranged for the liquid flow path 3, and the common liquid supply chamber 6 is communicated with the liquid supply port 5.

Between the liquid supply port 5 and the liquid flow path 3, the movable member 8 is arranged to be substantially parallel to the opening area of the liquid supply port 5 with a minute gap $\alpha$ (10 $\mu$m or less, for instance). The area of the movable member 8, which is surrounded at least by the free end portion and both sides continued therefrom, is made larger than the opening area S of the liquid flow path that faces the liquid flow path, and also, a minute gap $\beta$ is arranged each between the side portions of the movable member 8 and the side walls 10 of the liquid flow path. In this way, while the movable member 8 can move in the liquid flow path 3 without friction resistance, its displacement to the opening area side is regulated on the circumference of the opening area S, hence closing the liquid supply port 5 essentially to make it possible to prevent liquid flow from the liquid flow path 3 to the common liquid supply chamber 6. Also, in accordance with the present embodiment, the movable member 8 is positioned to face the elemental base plate 1. Then, one end of the movable member 8 is arranged to be the free end which can be displaced to the heat generating element 4 side of the elemental base plate 1, and the other end thereof is supported by the supporting member 9B.

Also, as in the fourth embodiment, it is preferable to arranged the relationship between the gap a between the opening edge of the liquid supply port 5 on the liquid flow path 3 side and the surface of the movable member 8 on the liquid supply port 5 side, and the overlapping width Wb of the movable member 8 in the widthwise direction, which is overlapped with the opening edge of the liquid supply port 5 on the liquid flow path 3 side, to be Wb>$\alpha$ for the enhancement of the discharge efficiency.

Further, as in the fifth embodiment, it is more preferable to arrange the relationship between the overlapping width Wa of the movable member 8 in the discharge port 7 direction, which is overlapped with the opening edge of the liquid supply port 5 on the liquid flow path 3 side, and the overlapping width Wb of the movable member 8 in the widthwise direction thereof to be Wb>Wa in order to stabilize the discharge characteristics.

(Seventh Embodiment)

Now, the description will be made of a base plate for use of head preferably adoptable for each of the modes described above, and a method for manufacturing a liquid discharge head as well.

The circuit and element, which are arranged to drive the heat generating elements 4 of the liquid discharge head described above, and to control the driving thereof, are provided for the elemental base plate 1 or the ceiling plate 2 in accordance with the functions that each of them should perform accordingly. Also, since the elemental base plate 1 and ceiling plate 2 are formed by silicon material for the circuit and element, it is possible to form them easily and precisely by use of the semiconductor wafer process technologies and techniques.

Now, hereunder, the description will be made of the structure of the elemental base plate 1 formed by use of the semiconductor wafer process technologies and techniques.

Figure 23:
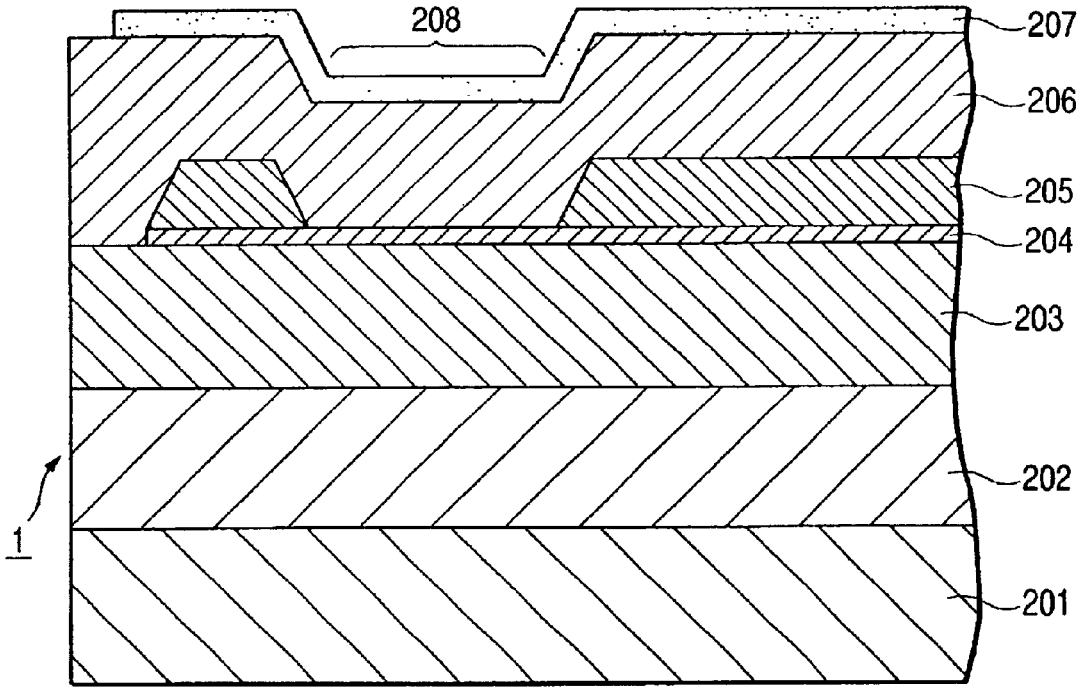
FIG. 23 is a cross-sectional view which shows the elemental base plate to be used for the liquid discharge head in accordance with each kind of embodiments.

FIG. 23 is a cross-sectional view which shows the elemental base plate 1 used for each of the embodiments described above. For the elemental base plate 1 shown in FIG. 23, there are laminated on the surface of silicon base plate 201, a thermal oxide film 202 serving as a heat accumulating layer, and an interlayer film 203 that dually functions as a heat accumulating layer in that order. For the interlayer film 203, $SiO_2$ film or $Si_3N_4$ film is used. Then, partially, on the surface of the interlayer film 203, a resistive layer 204 is formed. On the resistive layer 204, wiring 205 is formed partially. As the wiring layer 205, Al or Al—Si, Al—Cu or some other Al alloy wiring is adopted. On the surface of wiring 205, resistive layer 204, and interlayer film 203, a protection film 206 is formed with $SiO_2$ film or $Si_3N_4$ film. On the surface of the protection film 206 that corresponds to the resistive layer 204 and the circumference thereof, a cavitation proof film 207 is formed to protect the protection film 206 from chemical and physical shocks that follow the heating of the resistive layer 204. The area on the surface of the resistive layer 204, where no wiring 205 is formed, is arranged to become the thermoactive portion 208 upon which the heat of resistive layer 204 is allowed to act.

The films on the elemental base plate 1 are formed on the surface of a silicon base plate 201 one after another by use of semiconductor manufacturing technologies and techniques. Then, the thermoactive portion 208 is provided for the silicon base plate 201.

Figure 24:
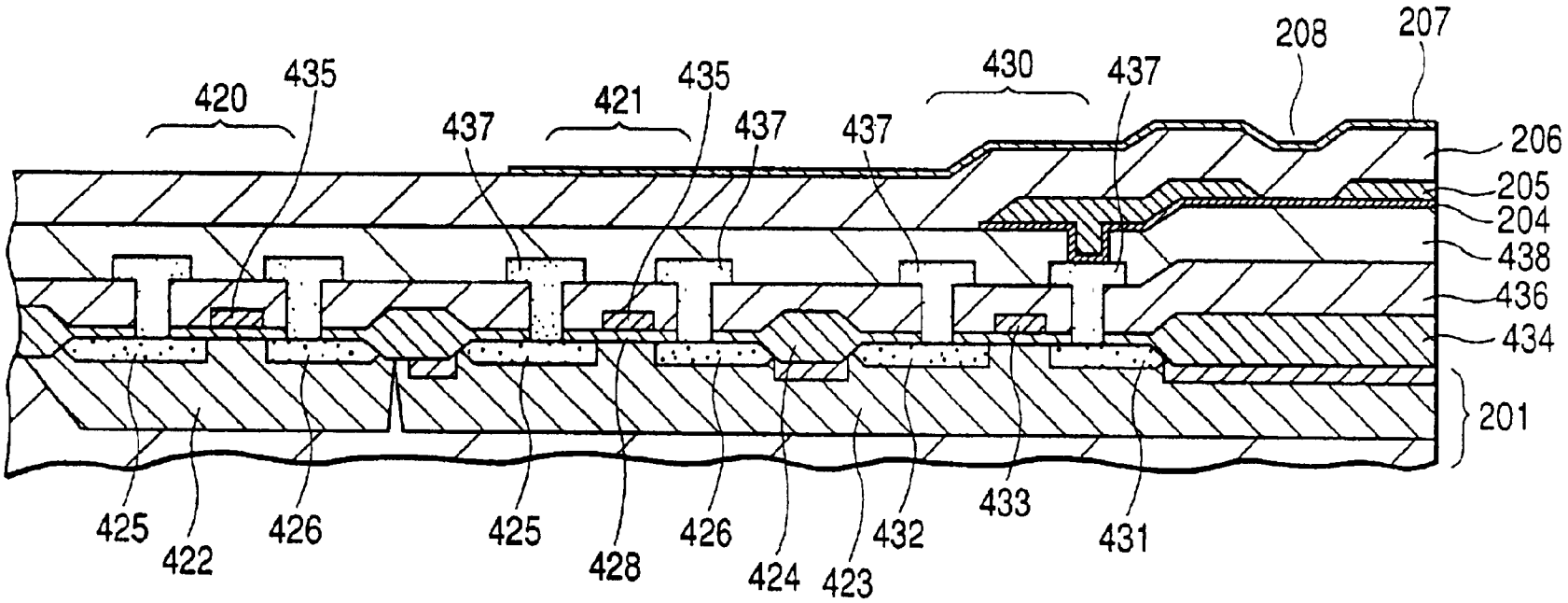
FIG. 24 is a cross-sectional view schematically showing the elemental base plate, which vertically cuts the principal element of the elemental base plate represented in FIG. 23.

FIG. 24 is a cross-sectional view which shows the elemental base plate 1 schematically by vertically cutting the principal part of the elemental base plate 1 represented in FIG. 23.

As shown in FIG. 24, on the surface layer of the silicon base plate 201 which is the P conductor, N type well region 422 and P type well region 423 are locally provided. Then, by use of the general MOS process, P-MOS 420 is provided for the N type well region 422 by ion plantation of impurities or the like and dispersion thereof, and N-MOS 421 is provided for the P type well region 423 thereby. The P-MOS 420 comprises the source region 425 and drain region 426 formed by inducing N-type or P-type impurities locally on the surface layer of the N type well region 422, and the gate wiring 435 deposited on the surface of the N type well region 422 with the exception of the source region 425 and drain region 426 through the gate insulation film 428 formed in a thickness of several hundreds of angstrom, among some others. Also, the N-MOS 421 comprises the source region 425 and drain region 426 formed by inducing N-type or P-type impurities locally on the surface layer of the P type well region 423, and the gate wiring 435 deposited on the surface of the P type well region 423 with the exception of the source region 425 and drain region 426 through the gate insulation film 428 formed in a thickness of several hundreds of angstrom, among some others. The gate wiring 435 is formed by polysilicon deposited by use of CVD method in a thickness of 4,000 Å to 5,000 Å. Then, C-MOS logic is formed by the P-MOS 420 and the N-MOS 421.

The portion of the P type well region 423, which is different from that of the N-MOS 421, is provided with the N-MOS transistor 430 for driving use of the electrothermal converting element. The N-MOS transistor 430 also comprises the source region 432 and the drain region 431, which are provided locally on the surface layer of the P type well region 423 by the impurity implantation and diffusion process or the like, and the gate wiring 433 deposited on the surface portion of the P type well region 423 with the exception of the source region 432 and the drain region 431 through the gate insulation film 428, and some others.

In accordance with the present embodiment, the N-MOS transistor 430 is used as the transistor for driving use of the electrothermal converting element. However, the transistor is not necessarily limited to this one if only the transistor is capable of driving a plurality of electrothermal converting elements individually, as well as it is capable of obtaining the fine structure as described above.

Between each of the elements, such as residing between the P-MOS 420 and the N-MOS 421 or between the N-MOS 421 and the N-MOS transistor 430, the oxidation film separation area 424 is formed by means of the field oxidation in a thickness of 5,000 Å and 10,000 Å. Then, by the provision of such oxidation film separation area 424, the elements are separated from each other, respectively. The portion of the oxidation film separation area 424, that corresponds to the thermoactive portion 208, is made to function as the heat accumulating layer 434 which is the first layer, when observed from the surface side of the silicon base plate 201.

On each surface of the P-MOS 420, N-MOS 421, and N-MOS transistor 430 elements, the interlayer insulation film 436 of PSG film, BPSG film, or the like is formed by the CVD method in a thickness of approximately 7,000 Å. After the interlayer insulation film 436 is smoothed by heat treatment, the wiring is arranged using the Al electrodes 437 that become the first wiring by way of the contact through hole provided for the interlayer insulation film 436 and the get insulation film 428. On the surface of the interlayer insulation film 436 and the Al electrodes 437, the interlayer insulation film 438 of $SiO_2$ is formed by the plasma CVD method in a thickness of 10,000 Å to 15,000 Å. On the portions of the surface of the interlayer insulation film 438, which correspond to the thermoactive portion 208 and N-MOS transistor 430, the resistive layer 204 is formed with $TaN_{0.8,hex}$ film by the DC sputtering method in a thickness of approximately 1,000 Å. The resistive layer 204 is electrically connected with the Al electrode 437 in the vicinity of the drain region 431 by way of the through hole formed on the interlayer insulation film 438. On the surface of the resistive layer 204, the Al wiring 205 is formed to become the second wiring for each-of the electrothermal converting elements.

The protection film 206 on the surfaces of the wiring 205, the resistive layer 204, and the interlayer insulation film 438 is formed with $Si_3N_4$ film by the plasma CVD method in a thickness of 10,000 Å. The cavitation proof film 207 deposited on the surface of the protection film 206 is formed by a thin film of at least one or more amorphous alloys in a thickness of approximately 2,500 Å, which is selected from among Ta (tantlum), Fe (iron), Ni (nickel), Cr (chromium), Ge (germanium), Ru (ruthenium), and some others.

Now, with reference to FIGS. 25A to 25D, FIGS. 26A to 26C and FIGS. 27A to 27C, the description will be made of one example of processes to manufacture the movable member 8, the flow path side walls 10, and the liquid supply port 5 on the elemental base plate 1 as shown in FIGS. 1 to 3. In this respect, FIGS. 25A to 25D, FIGS. 26A to 26C and FIGS. 27A to 27C are cross-sectional views taken in the direction orthogonal to the direction of liquid flow paths formed on the elemental base plate.

Figure 25A:
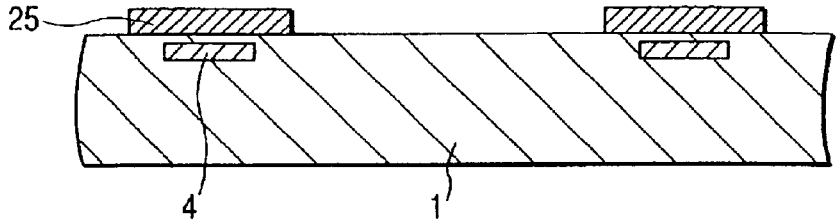
FIGS. 25A, 25B, 25C and 25D are views which illustrate a method for manufacturing a liquid discharge head in accordance with a fifth embodiment of the present invention.

At first, in FIG. 25A, Al film is formed by sputtering method on the surface of the elemental base plate 1 on the heat generating element 4 side in a thickness of approximately 2 $\mu$m. The Al film thus formed is patterned by the known photolithographic process to form a plurality of Al film patters 25 in the positions corresponding to each of the heat generating elements 2. Each of the Al film patterns 25 is extensively present up to the area where SiN film 26 is etched, which is the material film to form a part of the fixing member 9 and flow path side walls 10 in the step shown in FIG. 25C to be described later.

The Al film patter 25 functions as an etching stop layer when the liquid flow paths 3 are formed by use of dry etching to be described later. This arrangement is needed because the thin film, such as Ta, that serves as the cavitation proof film 207 on the elemental base plate 1, and the SiN film that serves as the protection layer 206 on the resistive element tend to be etched by the etching gas used for the formation of the liquid flow paths 3. The Al film pattern 25 prevents these layers or films from being etched. Therefore, in order not to allow the surface of the elemental base plate 1 on the heat generating element 4 side to be exposed when the liquid flow paths 3 are dry etched, the width of each Al film pattern 25 in the direction orthogonal to the flow path direction of the liquid flow path 3 is made larger than the width of the liquid flow path 3 which is formed ultimately.

Further, at the time of dry etching, ion seed and radical are generated by the decomposition of $CF_4$, $C_xF_y$, $SF_6$ gas, and the heat generating elements 4 and functional elements on the elemental base plate 1 may be damaged in some cases. However, the Al film pattern 25 receives such ion seed and radical so as to protect the heat generating elements 4 and functional elements on the elemental base plate 1 from being damaged.

Figure 25B:
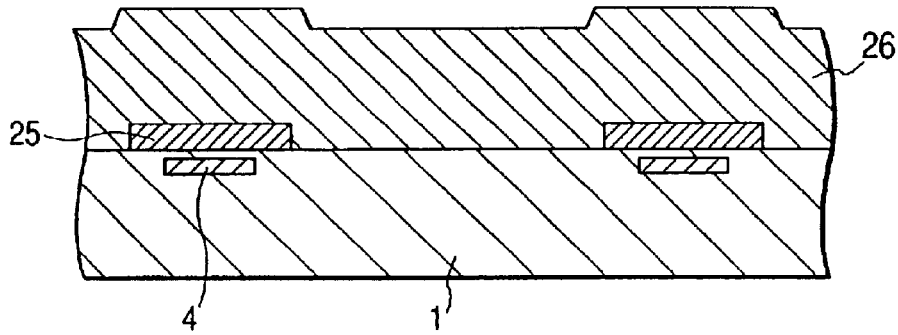

Then, in FIG. 25B, on the surface of the Al film pattern 25 and the surface of the elemental base plate 1 on the Al film pattern 25 side, the SiN film 26, which serves as the material film to form a part of flow path side walls 10, is formed by use of the plasma CVD method in a thickness of approximately 20.0 $\mu$m so as to cover the Al film pattern 25.

Figure 25C:
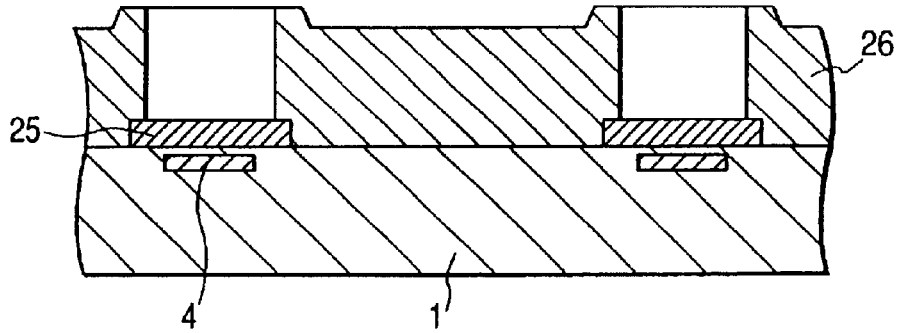

Then, in FIG. 25C, after the Al film is formed on the entire surface of the SiN film 26, the Al film thus formed is patterned by use of the known method, such as photolithography, to form the Al film (not shown) on the surface of the SiN film 26 with the exception of the portion where liquid flow paths 3 are formed. Then, the SiN film 26 is etched by an etching apparatus using dielectric coupling plasma to form a part of the flow path side walls 10. For the etching apparatus, a mixed gas of $CF_4$, $O_2$, and $SF_6$ is used for etching the SiN film 26 with the Al film pattern 25 adopted as the etching stop layer.

Figure 25D:
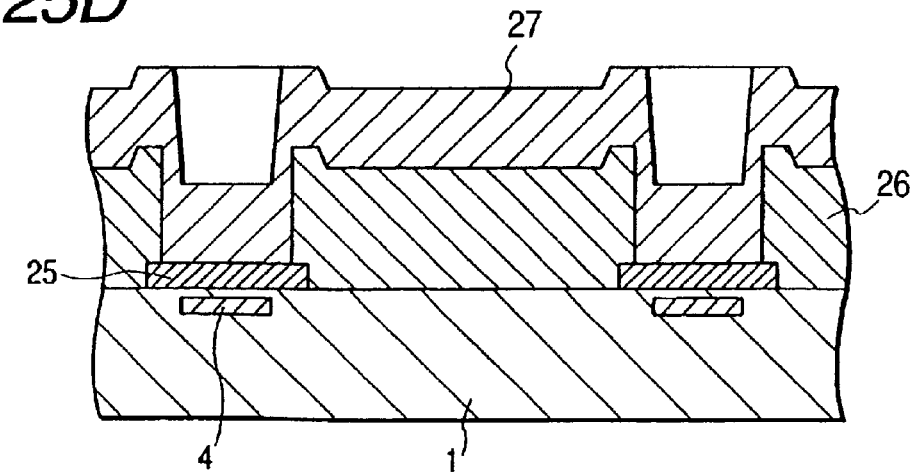

Then, in FIG. 25D, by use of sputtering method, Al film 27 is formed on the surface of the SiN film 26 in a thickness of 20.0 $\mu$m to bury with Al the holes which are produced by etching the SiN film 26 as the portions for the formation of the liquid flow paths 3 in the pre-processing step.

Figure 26A:
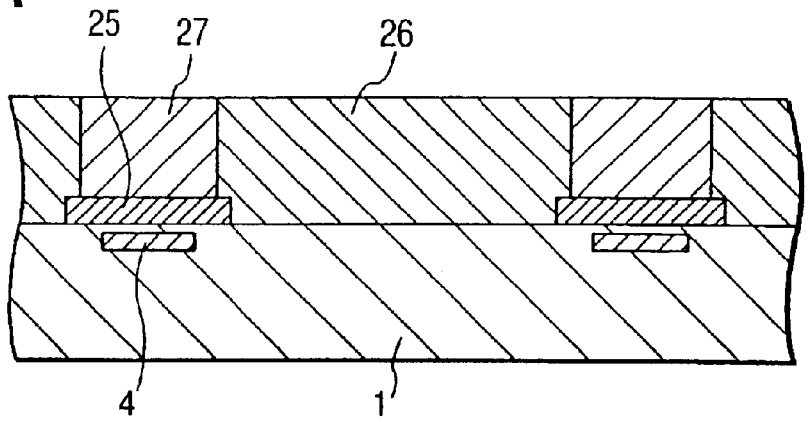
FIGS. 26A, 26B and 26C are views which illustrate the method for manufacturing a liquid discharge head in continuation of the processes shown in FIGS. 25A, 25B, 25C and 25D in accordance with the fifth embodiment of the present invention.

Now, in FIG. 26A, the surface of the SiN film 26 and the Al film 27 on the base plate 1 shown in FIG. 25D are flatly polished by means of CMP (Chemical Mechanical Polishing).

Figure 26B:
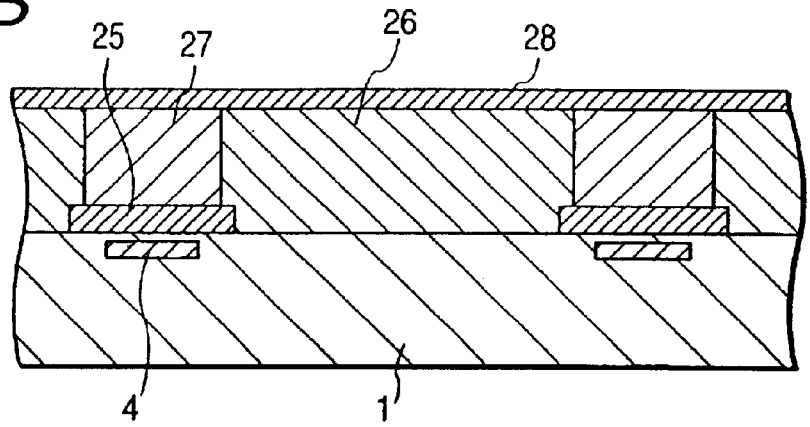

Then, in FIG. 26B, on the surface of the SiN film 26 and Al film 27 thus polished by means of CMP, Al film 28 is formed by sputtering method in a thickness of approximately 2.0 $\mu$m. After that, the Al film 28 thus formed is patterned by the known photolitho-graphical process. The pattern of the Al film 28 is extended up to the area where the SiN film is etched, which becomes the material film for the formation of the movable members 8 in the processing step in FIG. 26C to be described later. As described later, the Al film 28 functions as the etching stop layer when the movable members 8 are formed by dry etching. In other words, the SiN film 26 which becomes a part of the liquid flow paths 3 is prevented from being etched by etching gas to be used for the formation of movable members 8.

Figure 26C:
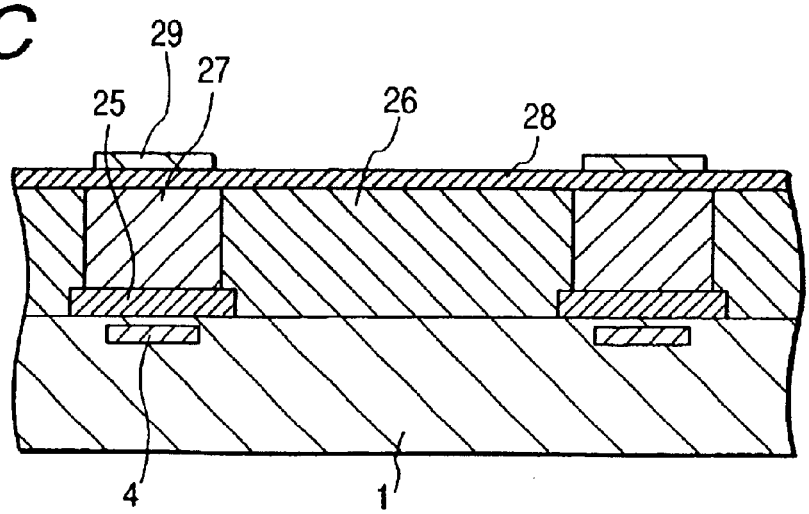

Then, in FIG. 26C, using plasma CVD method SiN film is formed on the surface of the Al film 28 in a thickness of approximately 3.0 $\mu$m, which becomes the material film for the formation of the movable members 8. The SiN film thus formed is dry etched by the etching apparatus using dielectric coupling plasma so that the SiN film 29 is left intact on the location corresponding to the Al film 28 which becomes a part of the liquid flow paths 3. The etching method by this apparatus is the same as the one adopted for the processing step in FIG. 25C. This SiN film 29 becomes the movable members 8 ultimately. Therefore, the width of the SiN film 29 pattern in the direction orthogonal to the flow path direction of the liquid flow path 3 is smaller than the width of the liquid flow path 3 which is ultimately formed.

Figure 27A:
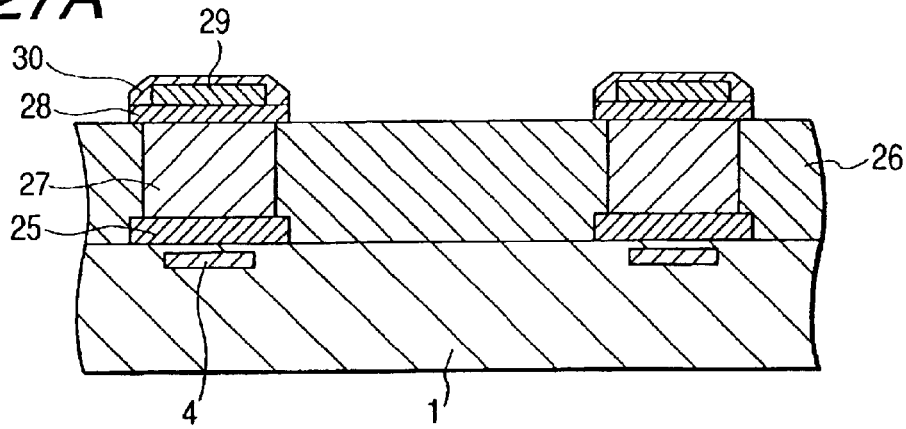
FIGS. 27A, 27B and 27C are views which illustrate the method for manufacturing a liquid discharge head in continuation of the processes shown in FIGS. 26A, 26B and 26C in accordance with the fifth embodiment of the present invention.

Then, in FIG. 27A, using sputtering method the Al film, which becomes the material film to form the gap formation member 30, is formed on the surface of the Al film 28 in a thickness of 3.0 $\mu$m so as to cover the SiN film 29. The Al film which is formed for the Al film 28 in the preprocessing step is patterned by use of the known photolithographic process, thus forming the gap formation member 30 on the surface and side faces of the SiN film 29 in order to form the gap $\alpha$ between the upper face of the movable member 8 and the liquid supply port 5, and the gap $\beta$ between the both sides of the movable member 8 and the flow path side walls 10 as shown in FIG. 2.

Figure 27B:
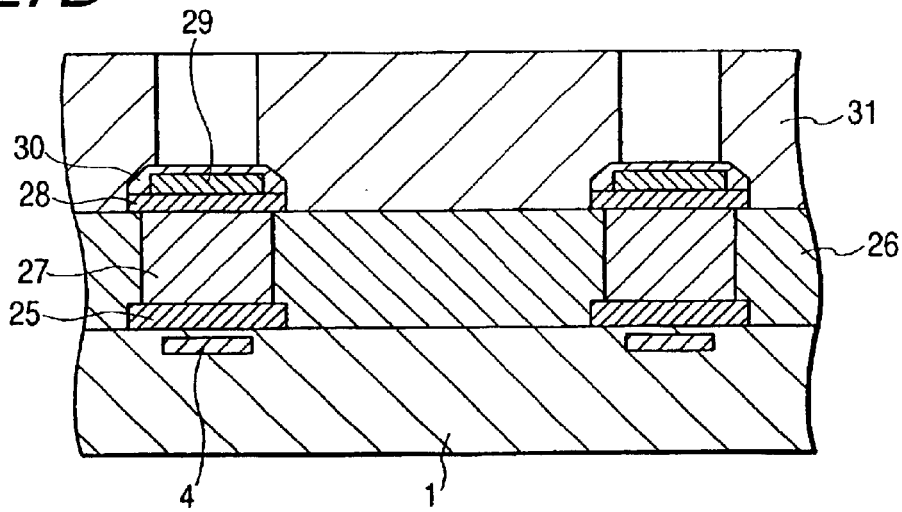

Then, in FIG. 27B, on the SiN film 26, the negative type photosensitive epoxy resin 31, which is formed by the materials shown in the Table 1 given below, is spin-coated on the aforesaid base plate that contains the gap formation member 30 formed by Al film in a thickness of 30.0 $\mu$m. Here, by the aforesaid spin-coating process, it is possible to coat epoxy resin 31 smoothly, which becomes a part of the flow path side walls 10 on which the ceiling plate 2 is bonded.

TABLE 1

| | |
|---|---|
| Material | SU-8-50 (manufactured by Microchemical Corp.) |
| Coating thickness | 50 $\mu$m |
| Prebaking | 90° C.<br>5 minutes<br>Hot plate |
| Exposing device | MPA 600 (Canon Mirror Projection aligner) |
| Quantity of exposure light | 2[J/cm$^2$] |
| PEB | 90° C.<br>5 minutes<br>Hot plate |
| Developer | propylene glycol 1 - monomethyl ether acetate (manufactured by Kishida Kagaku) |
| Regular baking | 200° C. 1 hr |

In continuation, as shown in the above Table 1, using the hot plate epoxy resin 31 is prebaked in condition of 90° C. for 5 minutes. After that, using the exposing device (Canon: MPA 600) the epoxy resin 31 is exposed to a specific pattern with a quantity of exposing light of 2[J/cm$^2$]. The exposed portion of the negative type epoxy resin is hardened, while the portion which is not exposed is not hardened. Thus, in the aforesaid exposing step, only the portion that excludes the portion becoming the liquid supply port 5 is exposed. Then, using the aforesaid developer the hole portion that becomes the liquid supply port 5 is formed. After that, the regular baking is made in condition of 200° C. for one hour. The area of opening of the hole portion that becomes the liquid supply port 5 is made smaller than the area of the SiN film 29 that becomes the movable member 8.

Figure 27C:
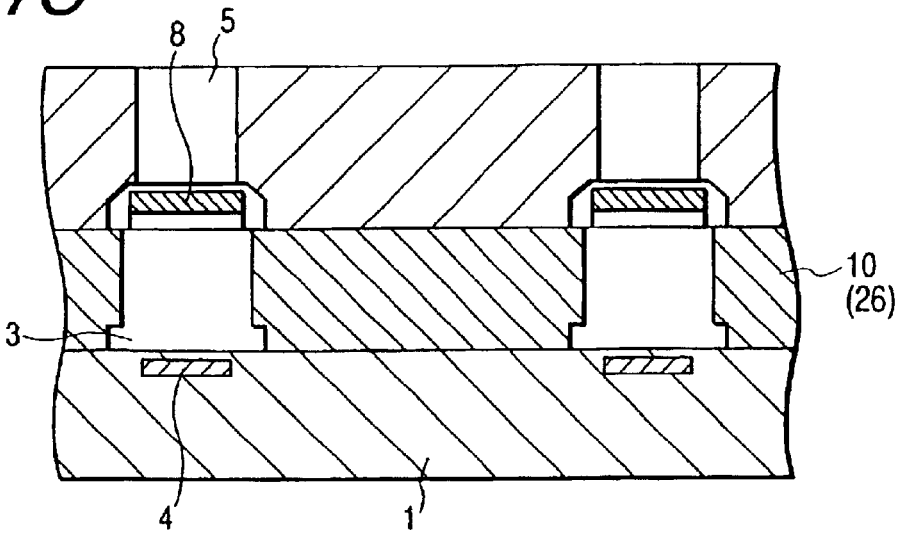

Lastly, in FIG. 27C, using mixed acids of acetic acid, phosphoric acid, and nitric acid the Al films 25, 27, 28, 30 are hot etched to elute them for removal. Then, the liquid supply port 5, the movable member 8, the fixing member 9, and the flow path side walls 10 are produced on the base plate 1. Here, gainless amorphous alloy is adopted for the uppermost surface layer of the elemental base plate 1 provided with the heat generating elements (bubble generating means) 4. Therefore, when the hot etching is performed with the aforesaid mixed acids, it becomes possible to prevent perfectly the wiring layer on the lower layer from being eroded by the presence of pin holes on the thin film or through the grain boundary region thereof.

As has been described above, the ceiling plate 2 provided with the common liquid supply chamber 6 of large capacity, which is communicated with each of the liquid supply ports 5 at a time, is bonded to the elemental base plate 1 having the movable members 8, the flow path side walls 10, and liquid supply ports 5 provided therefor, hence manufacturing the liquid discharge head shown in FIG. 1 to FIG. 3, and some others.

(Eighth Embodiment)

For the method of manufacture of the seventh embodiment described above, the description has been made of the manufacturing steps for the provision of the movable members 8, the flow path side walls 10, and the liquid supply ports 5 for the elemental base plate 1. However, the method is not necessarily limited thereto. It may be possible to adopt a process in which a ceiling plate 2 having already movable members 8 and liquid supply port 5 incorporated therein is bonded to the elemental base plate 1 having the flow path side walls 10 formed therefor.

Now, hereunder, with reference to FIGS. 28A to 28D, FIGS. 29A, 29B and 30, the description will be made of one example of such manufacturing process. FIGS. 28A to 28D and FIGS. 29A and 29B are cross-sectional views which illustrate the processing steps, taken in the direction orthogonal to the direction of the liquid flow paths formed on the elemental base plate. FIG. 30 is a cross-sectional view which schematically shows the structure of the liquid discharge head that uses the ceiling plate manufactured in the steps shown in FIG. 28A to FIG. 29B. Also, for the description here, the same reference marks are used for the same constituents as those appearing in the first embodiment.

Figure 28A:
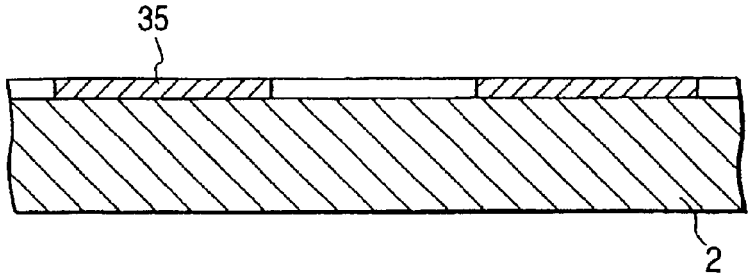
FIGS. 28A, 28B, 28C and 28D are views which illustrate a method for manufacturing a liquid discharge head in accordance with a sixth embodiment of the present invention.
Figure 29A:
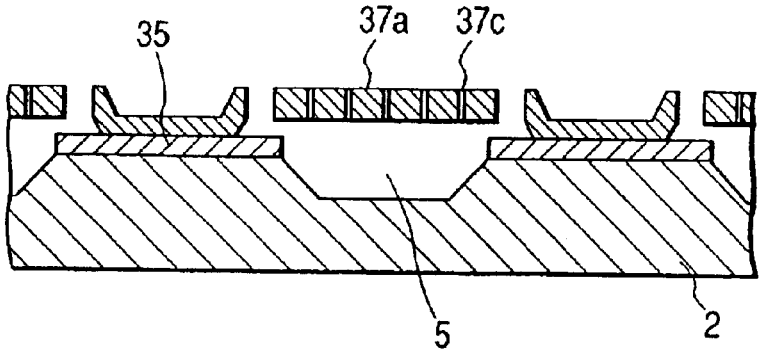
FIGS. 29A and 29B are views which illustrate the method for manufacturing a liquid discharge head in continuation of the processes shown in FIGS. 28A, 28B, 28C and 28D in accordance with the sixth embodiment of the present invention.

At first, in FIG. 28A, an oxide film ($SiO_2$) 35 is formed on one face of the ceiling plate 2 which formed by Si material in a thickness of approximately 1.0 $\mu$m. Then, the $SiO_2$ film 35 thus formed is patterned by use of the known photolithographic process to remove the $SiO_2$ film on the corresponding location where the liquid supply port 5 is formed as shown in FIG. 30.

Figure 28B:
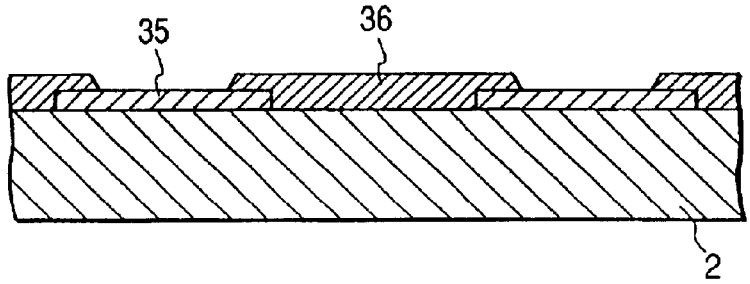

Then, in FIG. 28B, the portion of the $SiO_2$ film 35 on one face of the ceiling plate 2, where this film is removed, and the circumference thereof are covered by the gap formation member 36 formed by Al film in a thickness of approximately 3.0 $\mu$m. The gap formation member 36 is the one needed for forming a gap between the liquid supply port 5 and the movable member 8 which are formed in the step shown in FIG. 29B to be described later.

Figure 28C:
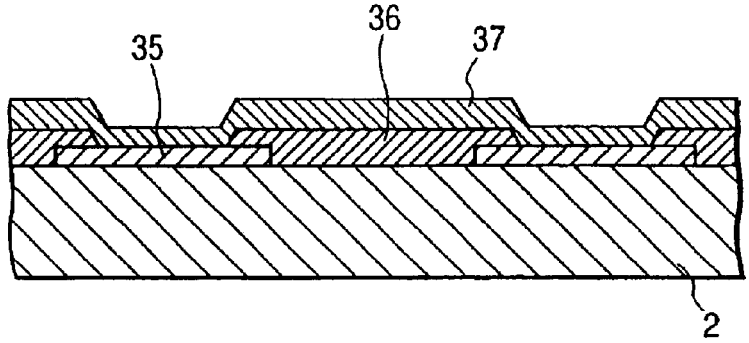

Then, in FIG. 28C, on the entire surface of the $SiO_2$ film 35 and the gap formation member 36, the SiN film 37, which is the material film for the formation of the movable member 8, is formed by use of the plasma CVD method in a thickness of approximately 3.0 $\mu$m so as to cover the gap formation member 36.

Figure 28D:
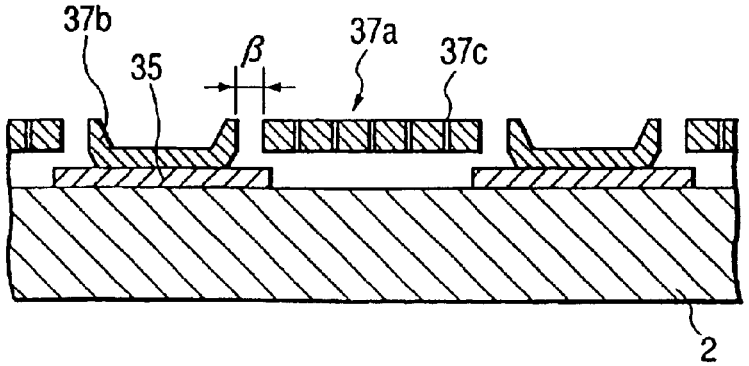

Then, FIG. 28D, the SiN film 37 is patterned by use of the known photolithographic process to form the movable member 8. After that, with the aforesaid gap formation member functioning as the etching stop layer, the penetration etching is performed for the Si ceiling plate (625 $\mu$m thick) to form the common liquid supply chamber. Subsequently, the Al film acting as the gap formation member 36 is hot etched by use of mixed acids of acetate acid, phosphoric acid, and nitric acid to elute it out for removable. In the aforesaid patterning, the gap $\beta$ between the movable portion 37*a*, which is the portion becoming the movable member 8, and the supporting member 37*b* on the SiN film 37 is set at 2 $\mu$m or more. Further, in the step which is shown in FIG. 29A to be described later, a plurality of slits 37*c* that penetrate from the surface to the backside of the movable portion 37*a* on the SiN film 37 are formed each preferably in a width of 1 $\mu$m or less in order to form the liquid supply port 5 easily corresponding to the movable member 8. Then, the projected area of the movable portion 37*a* is made larger than the opening area (the removed area of $SiO_2$ film 35) of the portion becoming the liquid supply port.

Then, in FIG. 29A, the portion of one face of the Si ceiling plate 2, where the $SiO_2$ film 35 is removed, is wet etched anisotropically through the slits 37*c* of the movable portion 37*a*, thus forming the liquid supply port 5.

Figure 29B:
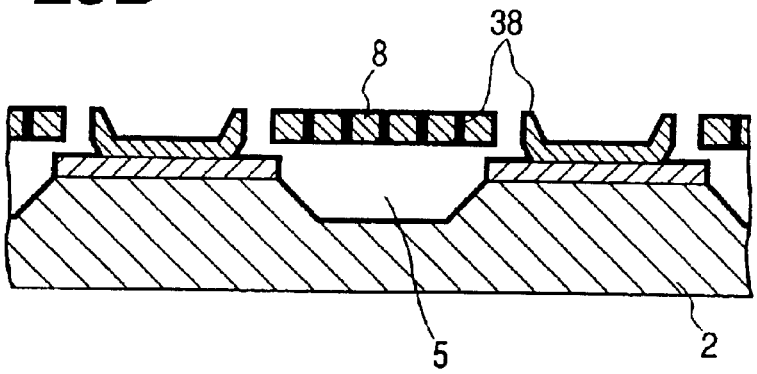
Figure 30:
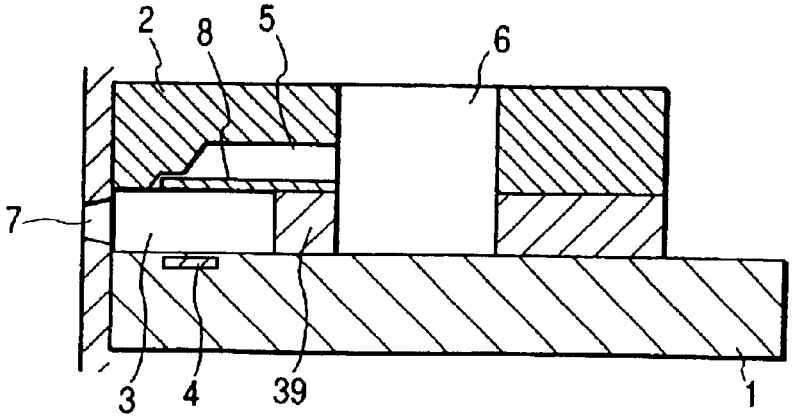
FIG. 30 is a cross-sectional view which shows schematically the structure of the liquid discharge head in accordance with the sixth embodiment of the present invention.

Lastly, in FIG. 29B, an SiN film 38 is formed by use of the LPCVD method on the portions produced in the steps so far in a thickness of approximately 0.5 $\mu$m. With the SiN film 38, the slits 37*c* open on the movable member 8 are buried. At this juncture, the gap of each slit 37*c* is set at 1 $\mu$m or less so that the slits 37*c* are buried, but the gap $\beta$ between the movable portion 37*a* and the supporting portion 37*b* thereof is set at 2 $\mu$m or more. As a result, the gap $\beta$ can never be buried by the SiN film 38. Also, the SiN film formed by the aforesaid LPCVD method is coated on the silicon side walls formed by the anisotropic etching, as well as by the penetrating etching of the silicon ceiling plate, thus preventing them from being eroded by ink.

For the member provided with the movable member 8 and the liquid supply port 5 arranged on the ceiling plate 2 side, there is further provided the common liquid supply chamber 6 of large capacity, which is communicated with each of the liquid supply ports 5 at a time. Then, to this member is bonded the elemental base plate 1 having flow path walls that form each of the liquid flow paths 3 one end of which is communicated with each discharge port 7, hence manufacturing the liquid discharge head shown in FIG. 30. The liquid discharge head of this mode, too, can demonstrate the same effect as the liquid discharge head whose structure is shown in FIGS. 1 to 3, and some others.

(Other Embodiments)

Hereinafter, the description will be made of various embodiments preferably suitable for the head that uses the principle of liquid discharge of the present invention.

(Side Shooter Type)

Figure 31:
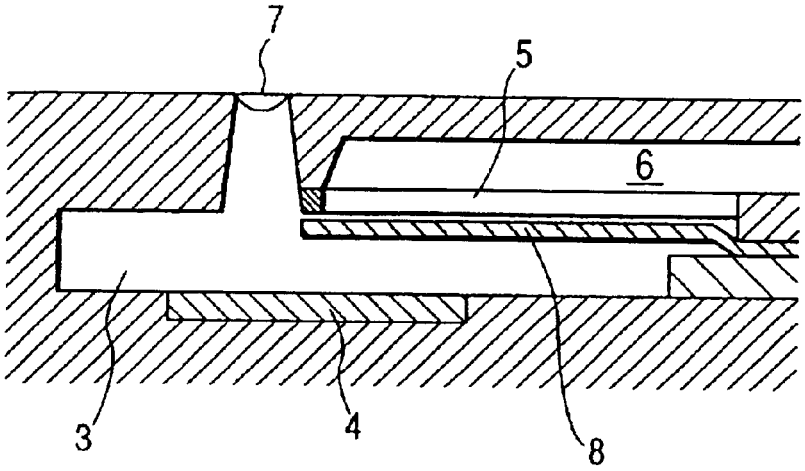
FIG. 31 is a view which illustrates the example of a head of side shooter type to which the liquid discharge method of the present invention is applicable.

FIG. 31 is a cross-sectional view which shows a liquid discharge head of the so-called side shooter type. For the description thereof, the same reference marks are applied to the same constitutes appearing in the first embodiment. The liquid discharge head of this mode is different from the one shown in the first embodiment and others in that as shown in FIG. 31, the heat generating element 4 and the discharge port 7 are arranged to face each other on the parallel planes, and that the liquid flow path 3 is communicated with the discharge port 7 at right angles to the axial direction of the liquid discharge therefrom. A liquid discharge head of the kind can also demonstrate the effect based upon the same discharge principle described in the first embodiment and others. Also, the method of manufacture described in accordance with the seventh and eighth embodiments is easily applicable thereto.

(Movable Member)

For each of the embodiments described above, the material that forms the movable member should be good enough if only it has resistance to solvent, as well as the elasticity that facilities the operation of the movable member in good condition.

As the material of the movable member, it is preferable to use a highly durable metal, such as silver, nickel, gold, iron, titanium, aluminum, platinum, tantalum, stainless steel, phosphor bronze, and alloys thereof; or resin of nitrile group, such as acrylonitrile, butadiene, styrene; resin of amide group, such as polyamide; resin of carboxyl group, such as polycarbonate; resin of aldehyde group, such as polyacetal; resin of sulfone group, such as polysulfone; and liquid crystal polymer or other resin and the compounds thereof; a highly ink resistive metal, such as gold, tungsten, tantalum, nickel, stainless steel, titanium; and regarding the alloys thereof and resistance to ink, those having any one of them coated on the surface thereof or resin of amide group, such as polyamide, resin of aldehyde group, such as polyacetal, resin of ketone group, such as polyether etherketone, resin of imide group, such as polyimide, hydropxyl group, such as phenol resin, resin of ethyl group, such as polyethylene, resin of alkyl group, such as polypropylene, resin of epoxy group, such as epoxy resin, resin of amino group, such as melamine resin, resin of methyrol group, such as xylene resin and the compound thereof; further, ceramics of silicon dioxide, silicon nitride, or the like, and the compound thereof. Here, the target thickness of the movable member of the present invention is of $\mu$m order.

Now, the arrangement relations between the heat generating member and movable member will be described. With the optimal arrangement of the heat generating element and the movable member, it becomes possible to control and utilize the liquid flow appropriately when bubbling is effected by use of the heat generating element.

Figure 32:
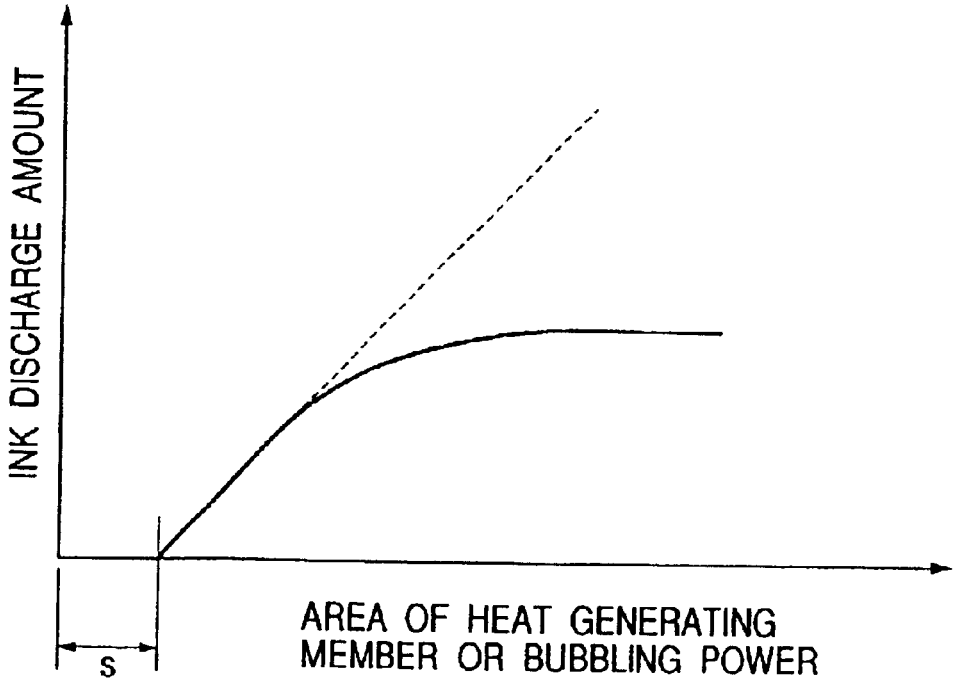
FIG. 32 is a graph which shows the correlation between the areas of heat generating element, and the amounts of ink discharges.

For the conventional art of the so-called bubble jet recording method, that is, an ink jet recording method whereby to apply heat or other energy to ink to create change of states in it, which is accompanied by the abrupt voluminal changes (creation of bubble), and then, use of the acting force based upon this change of states, ink is discharged from the discharge port to a recording medium for the formation of images thereon by the adhesion of ink thus discharged, the area of the heat generating element and the discharge amount of ink maintain the proportional relationship as indicated by slanted lines in FIG. 32. However, it is readily understandable that there exists the region S which effectuates no bubbling, which does not contribute to discharging ink. Also, from the burning condition on the heat generating element, this region S in which no bubbling is effected exists on the circumference of the heat generating element. With these results in view, it is assumed that the circumference of the heat generating element in a width of approximately 4 $\mu$m does not participate in bubbling. On the other hand, for the liquid discharge head of the present invention, the liquid flow path that includes the bubble generating means is essentially covered with the exception of the discharge port so that the maximum discharge amount is regulated. Therefore, as indicated by a solid line in FIG. 32, there is the area where no discharge amount is caused to change even when the fluctuation is large as to the area of heat generating element and bubbling power. With the utilization of such area, it is possible to attempt the stabilization of discharge amount for larger dots.

(Elemental Base Plate)

Hereunder, the description will be made of the structure of the elemental base plate 1 provided with the heat generating elements 10 for giving heat to liquid.

Figure 33A:
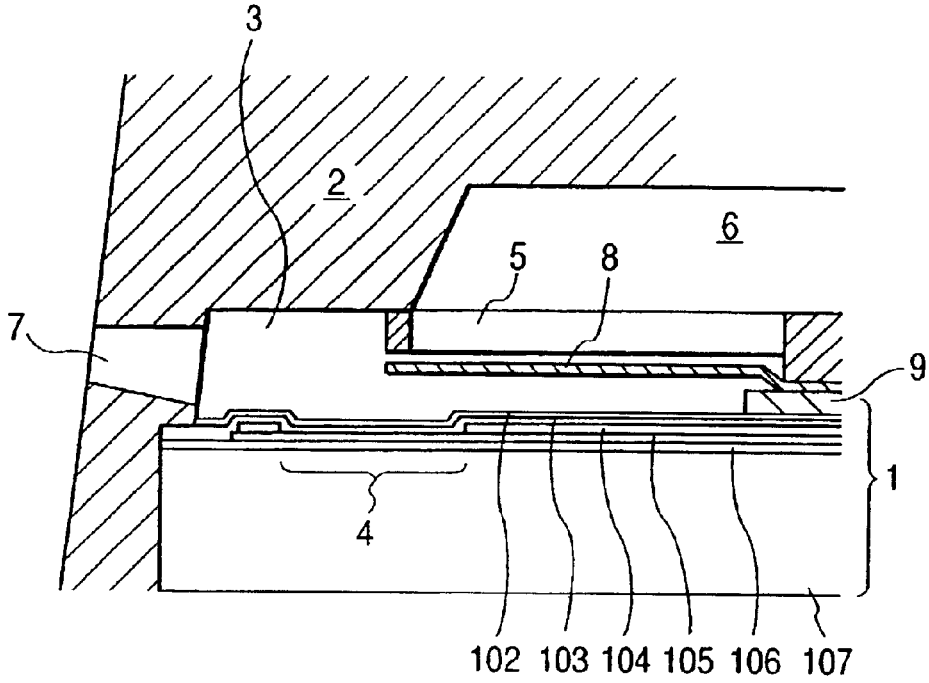
FIGS. 33A and 33B are vertically sectional views which illustrate the liquid discharge head of the present invention.
Figure 33B:
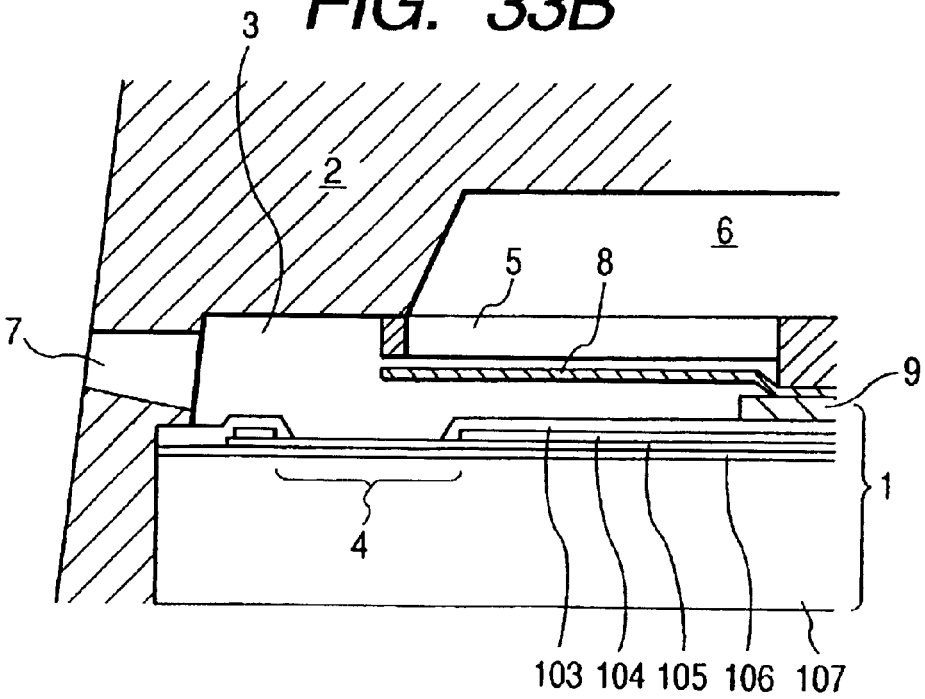

FIGS. 33A and 33B are side sectional views which illustrate the principal part of a liquid discharge apparatus in accordance with the present invention. FIG. 33A shows a head having a protection film to be described later. FIG. 33B shows a head without any protection film.

On an elemental base plate 1, a ceiling plate 2 is arranged, and each liquid flow path 3 is formed between the elemental base plate 1 and the ceiling plate 2.

For the elemental base plate 1, silicon oxide film or silicon nitride film 106 is filmed on a substrate 107 of silicon or the like for the purpose of making insulation and heat accumulation. On this film, there are pattered as shown in FIG. 33A an electric resistive layer 105 of halfniumboride ($HfB_2$), tantalum nitride (TaN), tantalum aluminum (TaAl), or the like, which structures the heat generating element 10 (in a thickness of 0.01 to 0.2 $\mu$m), and the wiring electrodes 104 of aluminum or the like (in a thickness of 0.2 to 1.0 $\mu$m). Voltage is applied to the resistive layer 105 through the wiring electrodes 104 to enable electric current to run through the resistive layer 105 to generate heat. On the resistive layer 105 between the wiring electrodes 104, the protection layer 103 of silicon oxide, silicon nitride, or the like is formed in a thickness of 0.1 to 2.0 $\mu$m. Further on this layer, the cavitation proof layer 102 of tantalum or the like is filmed (in a thickness of 0.1 to 0.6 $\mu$m), hence protecting the resistive layer 105 from ink or various other liquid.

The pressure and shock waves become intensified at the time of bubbling or bubbling extinction, in particular, which may cause the durability of the hard and brittle oxide films to be lowered significantly. To counteract this, a metallic material, such as tantalum (Ta), is used as the cavitation proof layer 102.

Also, by the combination of liquid, the flow path structure, and resistive materials, it may be possible to arrange a structure which does not need the protection film 103 for the aforesaid resistive layer 105. The example of such structure is shown in FIG. 33B. An alloy of iridium-tantalum-aluminum may be cited as a material of the resistive layer 105 that requires no protection film 103.

As described above, it may be possible to arrange only the resistive layer 105 (heat generating portion) between the electrodes 104 to form the structure of the heat generating element 4 for each of the embodiments described earlier. Here, also, it may be possible to arrange the structure so that a protection film 103 is included for the protection of the resistive layer 105.

For each of the embodiments, the structure is arranged with the heat generating portion formed by the resistive layer 105 which generates heat as the heat generating element 4 in accordance with electric signals, but the heat generating element is not necessarily limited thereto. Any heat generating element may be adoptable if only it can create bubble in bubbling liquid sufficiently so as to discharge discharging liquid. For example, such element may be an opto-thermal converting member that generates heat when receiving laser or some other light or the member which is provided with a heat generating portion that generates heat when receiving high frequency.

In this respect, on the aforesaid elemental base plate 1, functional devices, such as transistors, diodes, latches, shift registers, and others, which are needed to drive the heat generating elements 4 (electrothermal converting elements) selectively, may be integrally incorporated by use of the semiconductor manufacturing processes, besides the resistive layer 105 that constitutes the heat generating portion, and each heat generating element 4 formed by the wiring electrodes 104 to supply electric signals to the resistive layer 105.

Figure 34:
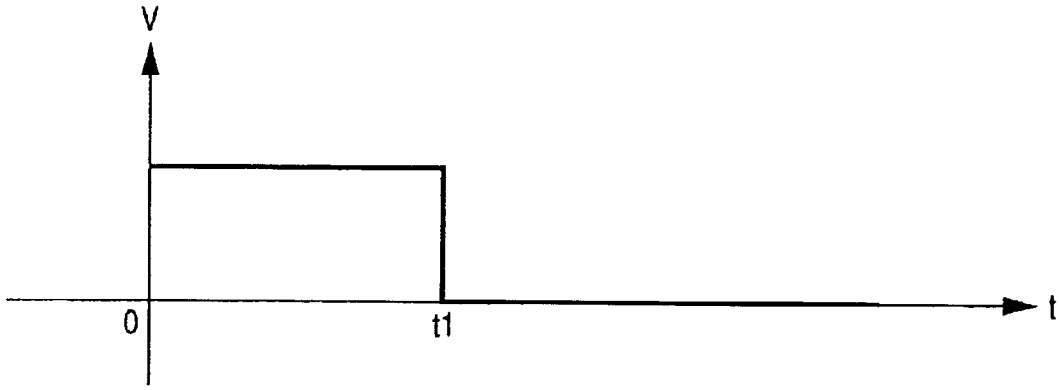
FIG. 34 is a view which shows the waveform at which to drive the heat generating element to be used for the present invention.

Also, in order to discharge liquid by driving the heat generating portion of each heat generating element 4 installed on the aforesaid elemental base plate 1, such rectangular pulses as shown in FIG. 34 are applied to the resistive layer 105 through the wiring electrodes 104 so as to enable the resistive layer 105 between the wiring electrodes 104 to be heated abruptly. For each head of the embodiments described earlier, the heat generating element is driven by the application of electric signals at 6 kHz, each having a voltage of 24V in the pulse width of 7 $\mu$sec with electric current of 150 mA. With the operation described above, ink which is liquid is discharged from each discharge port 7. However, the condition of driving signals is not necessarily limited thereto, but any driving signals may be adoptable if only bubbling liquid should be bubbled with them appropriately.

(Discharging Liquid)

Of such liquids as described earlier, it is possible to use ink having the same compositions as the one used for the conventional bubble jet apparatus as liquid usable for recording (recording liquid).

However, as the characteristics of discharging liquid, it is desirable to use the one which does not impede discharging, bubbling, or the operation of movable member by itself.

As the discharging liquid for recording use, highly viscous ink or the like can be used, too.

Further, for the present invention, ink of the following composition is used as the recording liquid that can be adopted as discharging liquid. However, with the enhanced discharging power which in turn makes ink discharge speed faster, the displacement accuracy of liquid droplets is improved to obtain recorded images in extremely fine quality.

TABLE 2

| | | |
|---|---|---|
| Dyestuff ink viscosity 2cP | (C.I. food black 2) dyestuffs | 3 wt% |
| | diethyle glycol | 10 wt% |
| | chiodiglycol | 5 wt% |
| | ethanol | 3 wt% |
| | water | 77 wt% |

(Liquid Discharge Apparatus)

Figure 35:
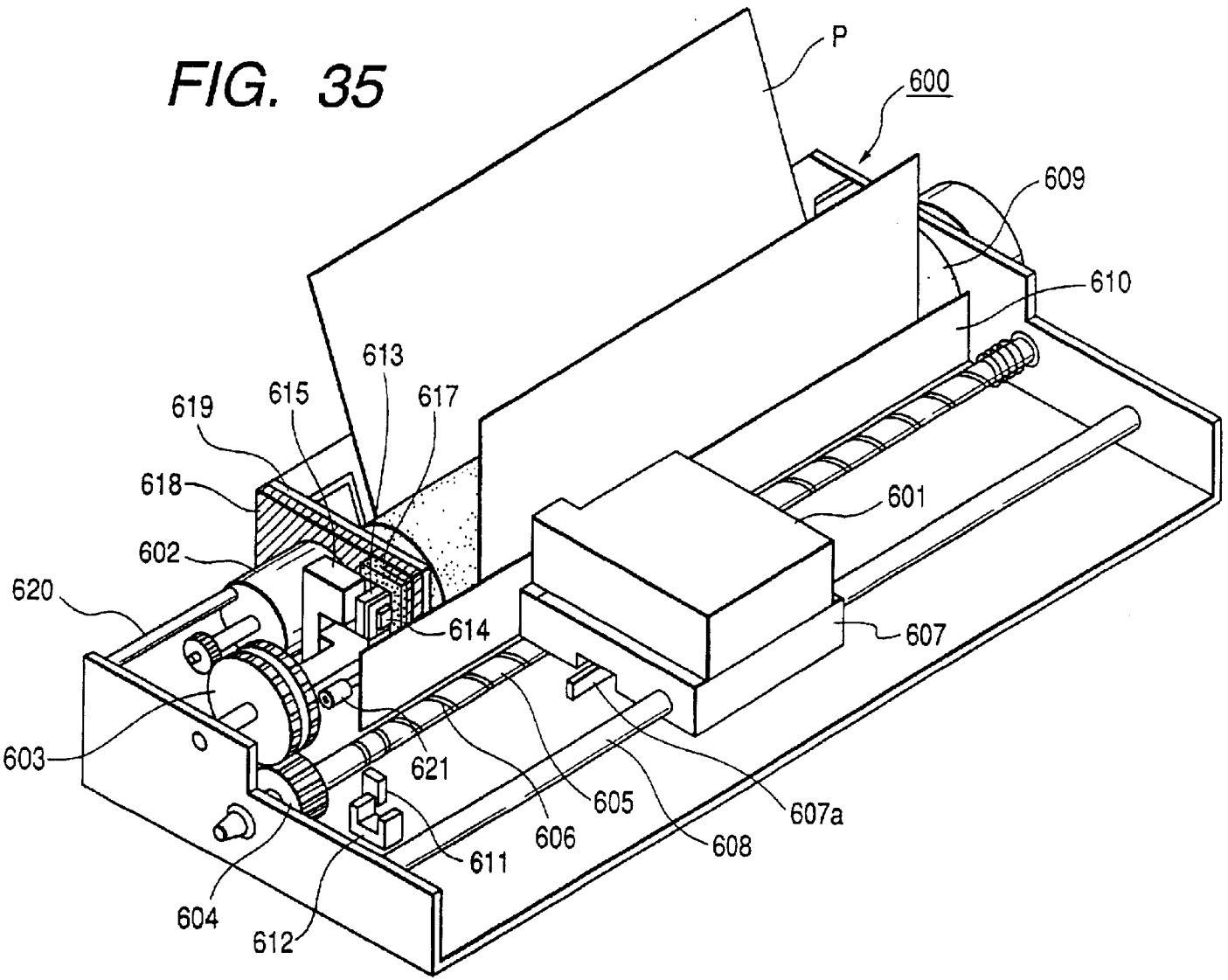
FIG. 35 is a view which schematically shows the structure of a liquid discharge apparatus having mounted on it the liquid discharge head of the present invention.

FIG. 35 is a view schematically showing the structure of an ink jet recording apparatus which is one example of the liquid discharge apparatus capable of installing on it for application the liquid discharge head described in accordance with each of the above embodiments. The head cartridge 601 installed on an ink jet recording apparatus 600 shown in FIG. 35 is provided with the liquid discharge head structured as described above, and the liquid container that contains liquid to be supplied to the liquid discharge head. As shown in FIG. 35, the head cartridge 601 is mounted on the carriage 607 that engages with the spiral groove 606 of a lead screw 605 rotating through driving power transmission gears 603 and 604 interlocked with the regular and reverse rotations of a driving motor 602. The head cartridge 601 reciprocates by the driving power of the driving motor 602 together with the carriage 607 along a guide 608 in the directions indicated by arrows a and b. The ink jet recording apparatus 600 is provided with recording medium carrying means (not shown) for carrying a printing sheet P serving as the recording medium that receives liquid, such as ink, discharged from the head cartridge 601. Then, the sheet pressure plate 610 for use of printing sheet P to be carried on a platen 609 by the recording medium carrying means, is arranged to press the printing sheet P to the platen 609 over the traveling direction of the carriage 607.

Photocouplers 611 and 612 are arranged in the vicinity of one end of the lead screw 605. The photocouplers 611 and 612 are the means for detecting home position which switches the rotational directions of the driving motor 602 by recognizing the presence of the lever 607*a* of the carriage 607 in the effective region of the photocouplers 611 and 612. In the vicinity of one end of the platen 609, a supporting member 613 is arranged for supporting the cap member 614 that covers the front end having the discharge ports of the head cartridge 601. Also, there is arranged the ink suction means 615 that sucks ink retained in the interior of the cap member 614 when idle discharges or the like are made from the head cartridge 601. With the ink suction means 615, suction recoveries of the head cartridge 601 are performed through the opening portion of the cap member 614.

For the ink jet recording apparatus 600, a main body supporting member 619 is provided. For this main body supporting member 619, a movable member 618 is movably supported in the forward and backward directions, that is, the direction at right angles to the traveling directions of the carriage 607. On the movable member 618, a cleaning blade 617 is installed. The mode of the cleaning blade 617 is not necessarily limited to this arrangement. Any known cleaning blade of some other modes may be applicable. Further, there is provided the lever 620 which initiates suction when the ink suction means 615 operates its suction recovery. The lever 620 moves along the movement of the cam 621 that engages with the carriage 607. The movement thereof is controlled by known transmission means such as the clutch that switches the driving power of the driving motor 602. The ink jet recording controller, which deals with the supply of signals to the heat generating elements provided for the head cartridge 601, as well as the driving controls of each of the mechanisms described earlier, is provided for the recording apparatus main body side, and not shown in FIG. 35.

For the ink jet recording apparatus 600 structured as described above, the aforesaid recording medium carrying means carries a printing sheet P on the platen 609, and the head cartridge 601 reciprocates over the entire width of the printing sheet P. During this reciprocation, when driving signals are supplied to the head cartridge 601 from driving signal supply means (not shown), ink (recording liquid) is discharged from the liquid discharge head unit to the recording medium in accordance with the driving signals for recording.

Figure 36:
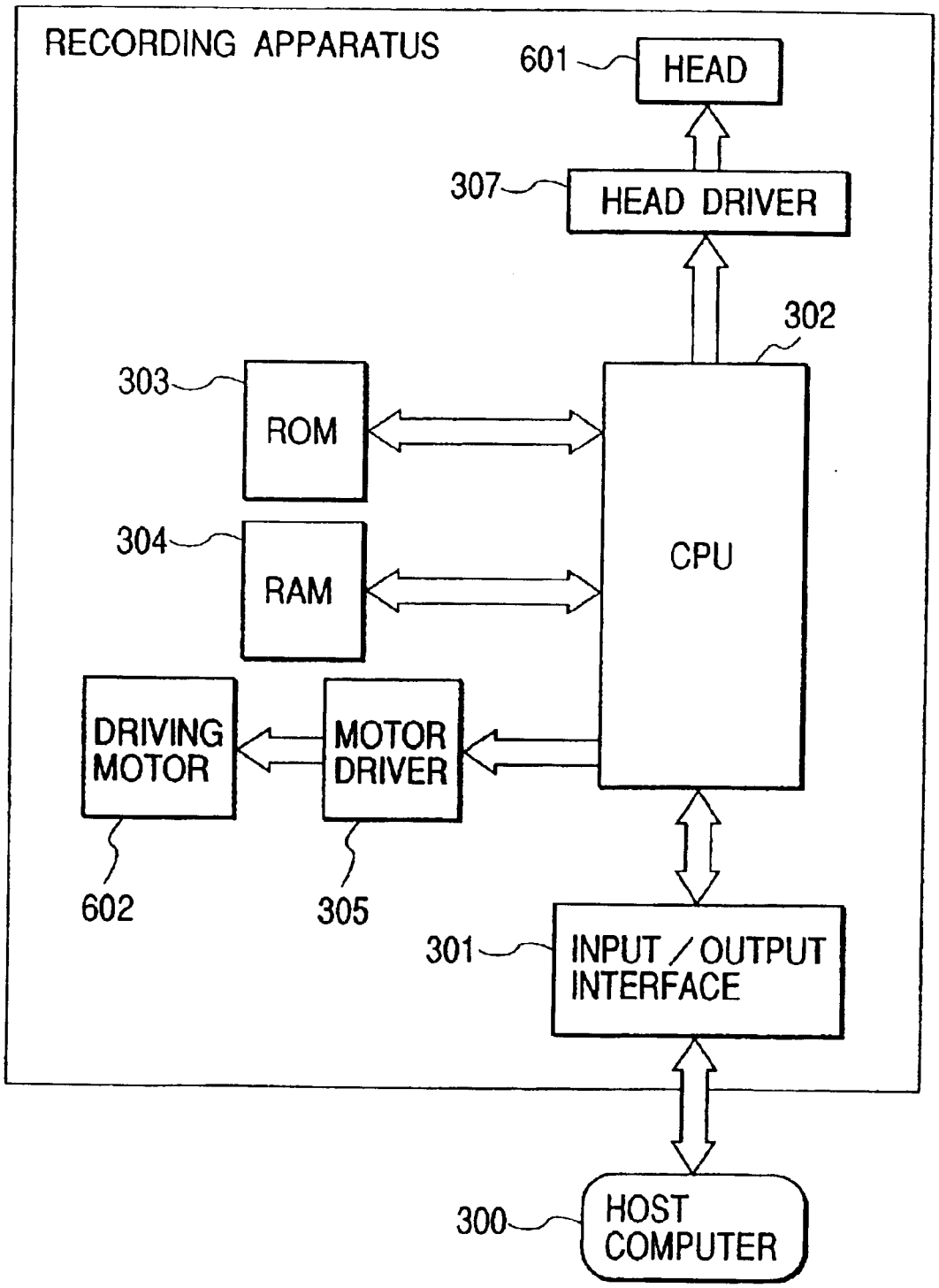
FIG. 36 is a block diagram which shows the entire body of an apparatus that performs liquid discharge recording by use of the liquid discharge method and liquid discharge head of the present invention.
Figure 37:
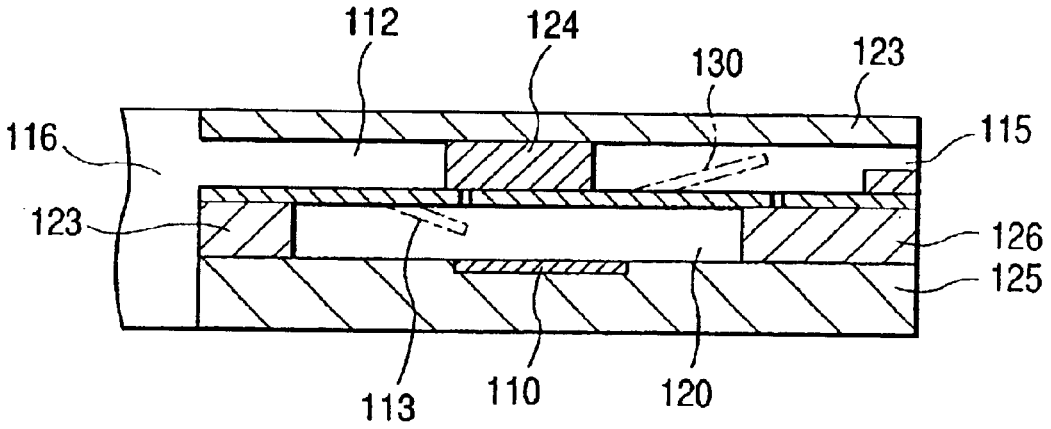
FIG. 37 is a cross-sectional view which shows the state of movable members for the conventional liquid discharge head.

FIG. 36 is a block diagram which shows the entire body of a recording apparatus for executing the ink jet recording by use of the liquid discharge apparatus of the present invention.

The recording apparatus receives printing information from a host computer 300 as control signals. The printing information is provisionally stored on the input interface 301 in the interior of a printing apparatus, and at the same time, converted into the data processible in the recording apparatus, thus being inputted into the CPU (central processing unit) 302 that dually functions as head driving signal supply means. The CPU 302 processes the data thus received by the CPU 302 using RAM (random access memory) 304 and other peripheral units in accordance with the control program stored on ROM (read only memory), and convert them into the data (image data) for printing.

Also, the CPU 302 produces the driving data which are used for driving the driving motor 602 for carrying the recording sheet and the carriage 607 to travel together with the head cartridge 601 mounted thereon in synchronism with image data in order to record the image data on appropriate positions on the recording sheet. The image data and the motor driving data are transmitted to the head cartridge 601 and the driving motor 602 through the head driver 307 and motor driver 305, respectively. These are driven at controlled timing, respectively, to form images.

For the recording medium 150 which is used for a recording apparatus of the kind for the adhesion of liquid, such as ink, thereon, it is possible to use, as an objective medium, various kinds of paper and OHP sheets; plastic materials used for a compact disc, ornamental board, and the like; cloths; metallic materials, such as aluminum, copper; leather materials, such as cowhide, pigskin, and artificial leathers; wood materials, such as wood, plywood; bamboo materials; ceramic materials, such as tiles; and three-dimensional structure, such as sponge, among some others.

Also, as the recording apparatus hereof, the followings are included: a printing apparatus for recording on various kinds of paper, OHP sheet, and the like; a recording apparatus for use of plastic materials which records on a compact disc, and other plastic materials; a recording apparatus for use of metallic materials that records on metallic plates; a recording apparatus for use of leather materials that records on leathers; a recording apparatus for use of wood materials that records on woods; a recording apparatus for use of ceramics that records on ceramic materials; and a recording apparatus for recording a three-dimensional netting structures, such as sponge. Also, a textile printing apparatus or the like that records on cloths is included therein.

Also, as discharging liquid usable for any one of these liquid discharge apparatuses, it should be good enough if only such liquid can be used matching with the respective recording mediums and recording conditions accordingly.

What is claimed is:

1. A liquid discharge head comprising:

a plurality of discharge ports for discharging liquid;

a plurality of liquid flow paths which are in communication with respective ones of said discharge ports, each having a bubble generating area for creating a bubble in the liquid;

bubble generating means for generating energy to create and grow the bubble;

a plurality of liquid supply ports arranged for respective ones of said liquid flow paths to be in communication with a common liquid supply chamber; and a movable member supported with a minute gap to said liquid supply port on said liquid flow path side, and provided with a free end, the area of said movable member surrounded at least by an edge of the free end and both sides of said movable member continued therefrom being made larger than an opening area of said liquid supply port facing the liquid flow path, and the free end of said movable member being minutely displaced in said liquid flow path to said liquid supply port side in the initial stage of said bubble creation, and wherein along with the bubble extinction, the free end of said movable member is largely displaced in said liquid flow path to said bubble generating means side for supplying liquid from said common liquid supply chamber into said liquid flow path through said liquid supply port.

2. A liquid discharge head according to claim 1, wherein the amount of displacement of the free end of said movable member is defined as h1 as the amount of displacement in the liquid flow path to said liquid supply port side in the initial stage of said bubble creation, and when the free end of said movable member is displaced in said liquid flow path to said bubble generating means side along with said bubble extinction, the amount of displacement thereof is defined as h2, and then, the relationship $$h1<h2$$

is true at all times.

3. A liquid discharge head according to claim 1, wherein a thin film of amorphous alloy is provided for the uppermost surface of said bubble generating means.

4. A liquid discharge head according to claim 3, wherein said amorphous alloy is an alloy of at least one metal or more selected from tantalum, iron, nickel, chromium, germanium, and ruthenium.

5. A liquid discharge head according to claim 1, further comprising a foot supporting member integrally formed with said movable member to support the foot of said movable member, said foot supporting member being provided with a step for deviating the height position of said movable member by one step to the fixing position of said foot supporting member, and the thickness of said movable member being larger than the amount of said step.

6. A liquid discharge head according to claim 1, wherein the relationship between a gap $\alpha$ between the opening edge of said liquid supply port on said liquid flow path side and the face of said movable member on said liquid flow supply port side, and the overlapping width W3 of said movable member in the widthwise direction overlapping with the opening edge of said liquid supply port on said liquid flow path side is $W3>\alpha$.

7. A liquid discharge head according to claim 6, wherein the relationship between the overlapping width W4 of said movable member in the discharge port direction overlapping with the opening edge of said liquid supply port on said liquid flow path side, and the overlapping width W3 of said movable member in the widthwise direction is W3>W4.

8. A liquid discharge apparatus comprising: a liquid discharge head according to claim 1; and recording medium carrying means for carrying a recording medium receiving liquid discharge from said liquid discharge head.

9. A liquid discharge apparatus according to claim 8, wherein ink is discharged from said liquid discharge head for recording by the adhesion of the ink to the recording medium.

* * * * *

UNITED STATES PATENT AND TRADEMARK OFFICE

CERTIFICATE OF CORRECTION

PATENT NO. : 6,854,831 B2
DATED : February 15, 2005
INVENTOR(S) : Masahiko Kubota et al.

It is certified that error appears in the above-identified patent and that said Letters Patent is hereby corrected as shown below:

Title page,
Item [75], Inventors, "Masahiko Kubota, Tokyo (JP); Hiroshi Sugitani, Tokyo (JP); Masanori Takenouchi, Kanagawa-ken (JP); Masami Ikeda, Tokyo (JP); Kiyomitsu Kudo, Kanagawa-ken (JP); Ryoji Inoue, Kanagawa-ken (JP); Takashi Saito, Kanagawa-ken (JP)" should read -- Masahiko Kubota, Tokyo (JP); Hiroshi Sugitani, Tokyo (JP); Masanori Takenouchi, Yokohama (JP); Masami Ikeda, Tokyo (JP); Kiyomitsu Kudo, Kawasaki (JP); Ryoji Inoue, Kawasaki (JP); Takashi Saito, Yokohama (JP) --.
Item [56], References Cited, FOREIGN PATENT DOCUMENTS, insert:
-- 05-229122 9/1993 --; and
-- EP 4-43798 8/1991 --.

Column 2,
Line 9, "unfavorably" should read -- unfavorable --.

Column 3,
Line 29, "higher significantly." should read -- significantly higher. --.
Line 59, "essential" should read -- essentially --.

Column 4,
Line 52, "to with" should read -- to --.

Column 8,
Line 4, "form" should read -- from --.
Line 15, "discharge," should read -- discharged, --.

Column 9,
Line 16, "reliably and quickly." should read -- reliable and quick. --.

Column 10,
Lines 21 and 29, "of" (second occurrence) should read -- of a --.

Column 11,
Line 38, "of" (first occurrence) should read -- of a --.

Column 16,
Line 13, "sate," should read -- state, --.
Line 19, "shows" should read -- showing --.
Line 32, "also" should read -- also a --.

UNITED STATES PATENT AND TRADEMARK OFFICE

CERTIFICATE OF CORRECTION

PATENT NO. : 6,854,831 B2
DATED : February 15, 2005
INVENTOR(S) : Masahiko Kubota et al.

It is certified that error appears in the above-identified patent and that said Letters Patent is hereby corrected as shown below:

Column 18,
Lines 3 and 23, “form” should read -- from --.

Column 19,
Line 65, “gap a” should read -- gap α --.

Column 20,
Line 26, “W3<α” should read -- W3≦α --.

Column 21,
Line 1, “fee” should read -- free --.
Line 21, “shows” should read -- show --.

Column 22,
Line 12, “arranged” should read -- arrange -- and “gap a” should read -- gap α --.

Column 24,
Line 44, “patters” should read -- patterns --.
Line 50, “patter” should read -- pattern --.

Column 28,
Line 49, “facilities” should read -- facilitates --.

Column 32,
Line 61, “followings” should read -- following --.

Signed and Sealed this

Fourth Day of April, 2006

JON W. DUDAS
*Director of the United States Patent and Trademark Office*